US011236572B2

(12) United States Patent
McAllister et al.

(10) Patent No.: US 11,236,572 B2
(45) Date of Patent: Feb. 1, 2022

(54) LEAD IMPRESSION TOOL

(71) Applicant: FMC Technologies, Inc., Houston, TX (US)

(72) Inventors: Shane McAllister, Houston, TX (US); Alex Wendeborn, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 16/913,892

(22) Filed: Jun. 26, 2020

(65) Prior Publication Data

US 2021/0404282 A1 Dec. 30, 2021

(51) Int. Cl.
*E21B 33/04* (2006.01)

(52) U.S. Cl.
CPC ..... *E21B 33/04* (2013.01)

(58) Field of Classification Search
CPC ..... E21B 33/04
See application file for complete search history.

(56) References Cited

U.S. PATENT DOCUMENTS

2012/0261132 A1* 10/2012 Wilson ..... E21B 47/098 166/348
2016/0102527 A1* 4/2016 Manson ..... E21B 47/098 166/301

* cited by examiner

*Primary Examiner* — Dany E Akakpo
(74) *Attorney, Agent, or Firm* — Osha Bergman Watanabe & Burton LLP

(57) ABSTRACT

A lead impression system having a downhole tool and a lead impression assembly assembled radially around the downhole tool is landed on a previously installed host casing hanger or a casing hanger being installed in the current/same trip to obtain a lead impression from the bore of the wellhead housing and indicate where the host casing hanger is located axially within the wellhead housing with respect to a feature on the bore of the wellhead housing from which the lead impression is obtained. Lead impression modules in the assembly have a lead pad that protrudes radially outward through a window on an outer sleeve according to a pressure differential between an internal and an external pressure of the lead impression assembly. The lead pad retracts to its pre-set position when the pressure differential exceeds a preset burst pressure.

11 Claims, 18 Drawing Sheets

LEAD IMPRESSION TOOL

BACKGROUND

Subsea hydrocarbon production systems typically include a wellhead positioned at the upper end of a well bore. The wellhead has a central bore within which a number of casing hangers are landed. Each casing hanger is connected to the top of a corresponding one of a number of concentric, successively smaller casing strings which extend into the well bore, with the uppermost casing hanger being connected to the innermost casing string. After the innermost casing string is installed, a tubing string is run into the well bore. The top of the tubing string is connected to a tubing hanger having a downward facing circumferential load shoulder which lands on a seat formed at the top of the uppermost casing hanger. In certain tubing hangers, the load shoulder is formed on a load nut which is threadedly connected to the tubing hanger body.

The tubing hanger is usually secured to the wellhead using a lockdown mechanism, such as a lock ring or a number of locking dogs. In order to ensure that the tubing hanger is properly locked to the wellhead, the vertical distance between the load shoulder and the locking dogs is substantially the same as the vertical distance between the seat and the locking profile, which is commonly referred to as the wellhead space-out, wherein the vertical distance between the seat and the locking profile is such that the locking ridges can fully engage their corresponding locking grooves. In tubing hangers in which the load shoulder is formed on a load nut that is threadedly connected to the tubing hanger body, the vertical distance between the load shoulder and the locking dogs can be adjusted by rotating the load nut relative to the tubing hanger body. Thus, once the wellhead space-out is determined, the load nut can be rotated until the vertical distance between the load shoulder and the locking dogs is the same as the wellhead space-out.

A lead impression tool is sometimes used to measure the wellhead space-out. In subsea wellheads, the lead impression tool is lowered on a drill string and landed on the seat. The lead impression tool is then hydraulically actuated to press circumferentially spaced lead impression pads into the locking profile. After the impressions are obtained, the lead impression tool is retrieved to the surface and mounted on a storage/test stand, which is then manually adjusted to match the wellhead space out, as measured by the lead impression tool. The tubing hanger is then mounted on the storage/test stand and the load nut is adjusted until the vertical distance between the load shoulder and the locking dogs is the same as the wellhead space-out.

SUMMARY

In one aspect, embodiments of the present disclosure include a lead impression system that includes a downhole tool, an outer sleeve assembled radially around the downhole tool and having at least one window formed there through, and a lead impression assembly assembled radially between the downhole tool and the outer sleeve, where the lead impression assembly has at least one accumulator, a pressure relief device, at least one piston having a piston head disposed within a bore of a piston chamber, at least one lead impression module, and a plurality of conduits and valves in fluid communication between the at least one accumulator, the pressure relief device, the at least one piston, and the at least one lead impression module.

In another aspect, embodiments of the present disclosure relate to lead impression assemblies that include at least one accumulator charged to a pre-set pressure, a pressure relief device, at least one piston having a piston head disposed within a bore of a piston chamber, wherein one side of the piston head is in a fluid communication with a port to the at least one accumulator and the other side in fluid communication with the environment, at least one lead impression module. A lead impression module may include a lead pad aligned with the at least one window in the outer sleeve, a piston module, and springs configured to apply a pressure from the piston module to the lead pad and from the lead pad to the module. The lead impression assembly may further include a plurality of conduits and valves in fluid communication between the at least one accumulator, the pressure relief device, the at least one piston, and the at least one lead impression module.

In yet another aspect, embodiments of the present disclosure relate to methods of taking a lead impression downhole that include sending an actuatable assembly to a downhole location, changing an external pressure downhole around the actuatable assembly at the downhole location, and using the changing external pressure downhole to initiate taking a lead impression with the actuatable assembly.

Other aspects and advantages of this disclosure will be apparent from the following description made with reference to the accompanying drawings and the appended claims.

DETAILED DESCRIPTION

Figure 1:
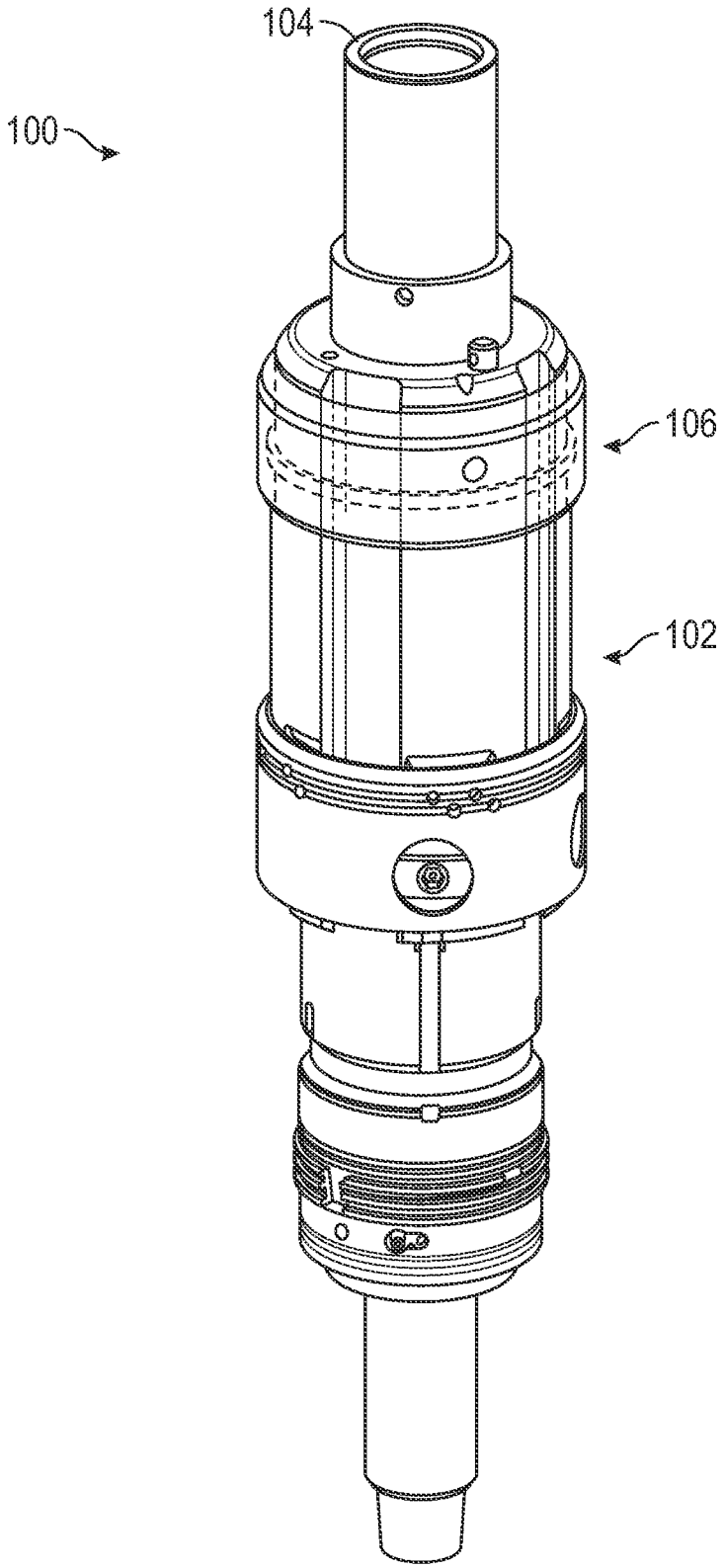
FIG. 1 (Prior Art)
FIG. 1 shows a perspective view of a conventional downhole tool.

Embodiments of the present disclosure relate generally to a lead impression assembly, which may be interchangeably mounted to downhole tools, for obtaining lead impressions downhole. Lead impressions may be obtained by pressing a lead pad from the lead impression assembly into a downhole surface (e.g., an inner surface of a casing or tubular), such that the topology of the downhole surface is impressed into the lead pad, thereby forming a negative of the downhole surface geometry. The lead impression may be analyzed to interpret what was contacted, thereby indicating where the lead impression was taken at the downhole location (e.g., depth from surface).

Embodiments herein may provide technical advantages in eliminating a dedicated lead impression tool trip by combining a lead impression function during a single trip with a downhole tool to identify wellhead space out of a host casing which has previously been installed or is in the process of being installed during the current trip downhole.

In accordance with embodiments of the present disclosure, a lead impression system may include a downhole tool, an outer sleeve, and a lead impression assembly. The assembly may be radially assembled around the downhole tool within the outer sleeve (where the lead impression assembly may be radially between the downhole tool and the outer sleeve). The assembly may include at least one accumulator that is charged to a pre-set pressure, a pressure relief device, at least one piston, at least one lead impression module, and a plurality of conduits and valves that are in fluid communication between the components within the assembly.

The at least one piston in some embodiments may include a piston head disposed within a bore of a piston chamber, where a first side of the piston head is in a fluid communication with a port to the at least one accumulator. A pressure relief device may vent the internal pressure of the assembly once a pressure differential between the internal and the external pressure is reached at a burst pressure.

The lead impression module in the lead impression assembly includes a lead pad that may protrude radially outward through a window on the outer sleeve according to the pressure differential between an external pressure and an internal pressure of the assembly when the lead impression module is assembled adjacent to and aligned with the window in the outer sleeve. Springs may be arranged between the lead pad and a piston module to apply a pressure from the piston module to the lead pad and from the lead pad to the piston module.

A method of obtaining a lead impression downhole according to embodiments of the present invention may begin with sending the lead impression system to a downhole location. Once the system sets and lands on or interfaces with the installed host casing hanger, an operator may increase the external pressure for an annulus seal assembly setting. The increased external pressure may increase the internal pressure of an actuatable assembly (e.g., by pushing on a piston in the actuatable assembly). The operator may then bleed down the external pressure upon the completion of the annulus seal assembly setting. This creates the pressure differential between the external and the internal pressure of the assembly, which pushes at least one lead pad radially outward through a window on the outer sleeve to obtain a lead impression on the inner profile of the wellhead housing.

Once the pressure differential reaches the burst pressure of the pressure relief device, the assembly is vented, and the at least one protruded pad may retract to its pre-set position.

According to embodiments of the present disclosure, a lead impression assembly may be mounted to different types of downhole tools, such as completion tools, where the lead impression assembly may be removed and/or reused on different types of downhole tools without any modification to the downhole tool for a mounting configuration prior to a downhole operation. For example, a lead impression assembly may be assembled around a single trip completion tool, and the lead impression assembly and single trip completion tool may be sent to a downhole location to take lead impressions of a downhole casing and/or tubular in order to locate where the single trip completion tool landed on a host casing. Lead impression assemblies according to embodiments of the present disclosure may be compatible with currently available downhole tool models, such as High Capacity Wellhead System series (UWD-HC) from TechnipFMC plc.

Further, an outer sleeve may be positioned around a lead impression assembly, such that the lead impression assembly is assembled radially between a downhole tool and the outer sleeve. In some embodiments, a lead impression assembly may be assembled within and attached to an outer sleeve prior to mounting the lead impression assembly and outer sleeve to a downhole tool. In some embodiments, a lead impression assembly may be attached to the downhole tool prior to mounting an outer sleeve around the lead impression assembly. In some embodiments, an available downhole tool may have a shoulder, formed around an outer surface of the downhole tool, on which a lead impression assembly and outer sleeve may be mounted.

A non-limiting example of a currently available downhole tool without a lead impression assembly is shown in FIG. 1. As shown, the downhole tool 100 has a generally tubular body 102. A threaded connection 104 may be provided at one or both axial ends of the tool 100 for connection to a string and/or other downhole tools. A tool sleeve 106 (which is different from the outer sleeve of a lead impression assembly disclosed herein) is radially arranged around the downhole tool 100. According to embodiments of the present disclosure, the tool sleeve 106 may be removed, and a lead impression assembly of the present disclosure may be installed in its place. An outer sleeve housing the lead impression assembly may use the same mounting interface as the tool sleeve 106 shown in FIG. 1, and thus, the downhole tool 100 may not require any modification of the mounting interface for installation of the lead impression assembly.

Figure 2:
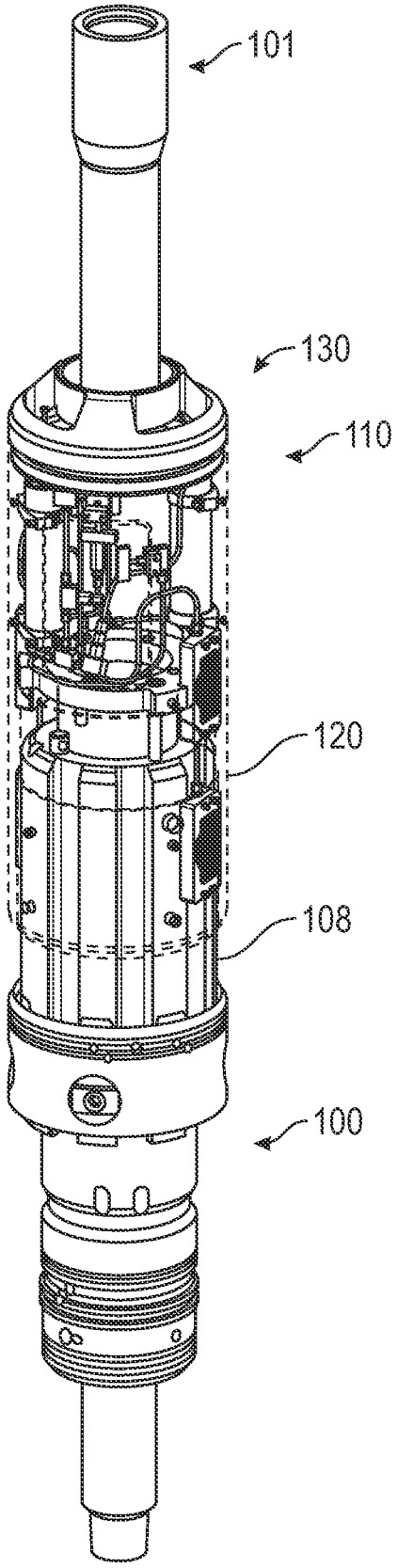
FIG. 2 shows a lead impression system according to embodiments of the present disclosure.

For example, FIG. 2 shows a lead impression assembly 110 and an outer sleeve 120 with a top bumper 130 mounted onto the downhole tool 100 of FIG. 1. As used herein, the assembly of a downhole tool and a lead impression assembly according to embodiments of the present disclosure may be referred to as a lead impression system. The lead impression system 101 shown in FIG. 2 may be assembled by providing an available downhole tool 100, such as shown in FIG. 1, and assembling a lead impression assembly 110 around the exterior of the downhole tool 100. An outer sleeve 120 and a top bumper 130 may further be assembled on the downhole tool 100 to house and protect the internal components of the lead impression assembly 110 from the environment. In some embodiments, an outer sleeve 120 may be assembled onto the downhole tool 100 after the lead impression assembly 110 is mounted to the downhole tool 100. In other embodiments, the lead impression assembly 110 may be assembled within and attached to the outer sleeve 120 prior to mounting the lead impression assembly 110 and outer sleeve 120 to the downhole tool 100. In such embodiments, the lead impression assembly 110 may be directly mounted to an interior side of the outer sleeve 120.

The top bumper 130 may be fitted on a top side of the outer sleeve 120. The top bumper 130 may provide support for the outer sleeve 120, for example, to minimize movement of the outer sleeve 120 around the downhole tool 100. Further, the top bumper 130 may cover and seal an annular opening formed between the top side of the outer sleeve 120 and the downhole tool 100, or the top bumper 130 may have one or more openings to allow access to the annular space between the outer sleeve 120 and downhole tool 100. A top bumper 130 may be attached to the outer sleeve 120 or integrally formed with the outer sleeve 120. In some embodiments, a lead impression system 101 may be provided without a top bumper 130.

According to some embodiments of the present disclosure, the lead impression assembly 110 may be directly attached to the outer sleeve 120 through socket head cap screws, mounting brackets, welding, or other attachment mechanisms. The outer sleeve 120 with the lead impression assembly 110 secured thereto may be assembled onto a shoulder or other mounting interface of the downhole tool 100. For example, a tool sleeve 106 (shown in FIG. 1) around an available downhole tool 100 may be removed, and the lead impression assembly 110 and outer sleeve 120 may be installed in the same location that the tool sleeve 106 had been around the exterior of downhole tool 100. The outer sleeve 120 may be mounted to the downhole tool 100 using the same mounting interface that the tool sleeve 106 used, which may include threaded holes around the downhole tool 100. In such embodiments, threaded holes that are formed in the downhole tool 100 may be aligned with holes on the outer sleeve 120, and screws or bolts 108 may be used to fasten the outer sleeve 120 onto the downhole tool 100.

In some embodiments, an available downhole tool 100 may include a shoulder or protrusion formed around an exterior surface of the downhole tool 100, which may act as a mounting interface for a sleeve. An outer sleeve 120 may include a wall having an inner diameter less than an outer diameter of a shoulder formed around the downhole tool 100, such that the shoulder of the downhole tool 100 may prevent axial movement of the outer sleeve 120 in a direction along the downhole tool 100.

Figure 3:
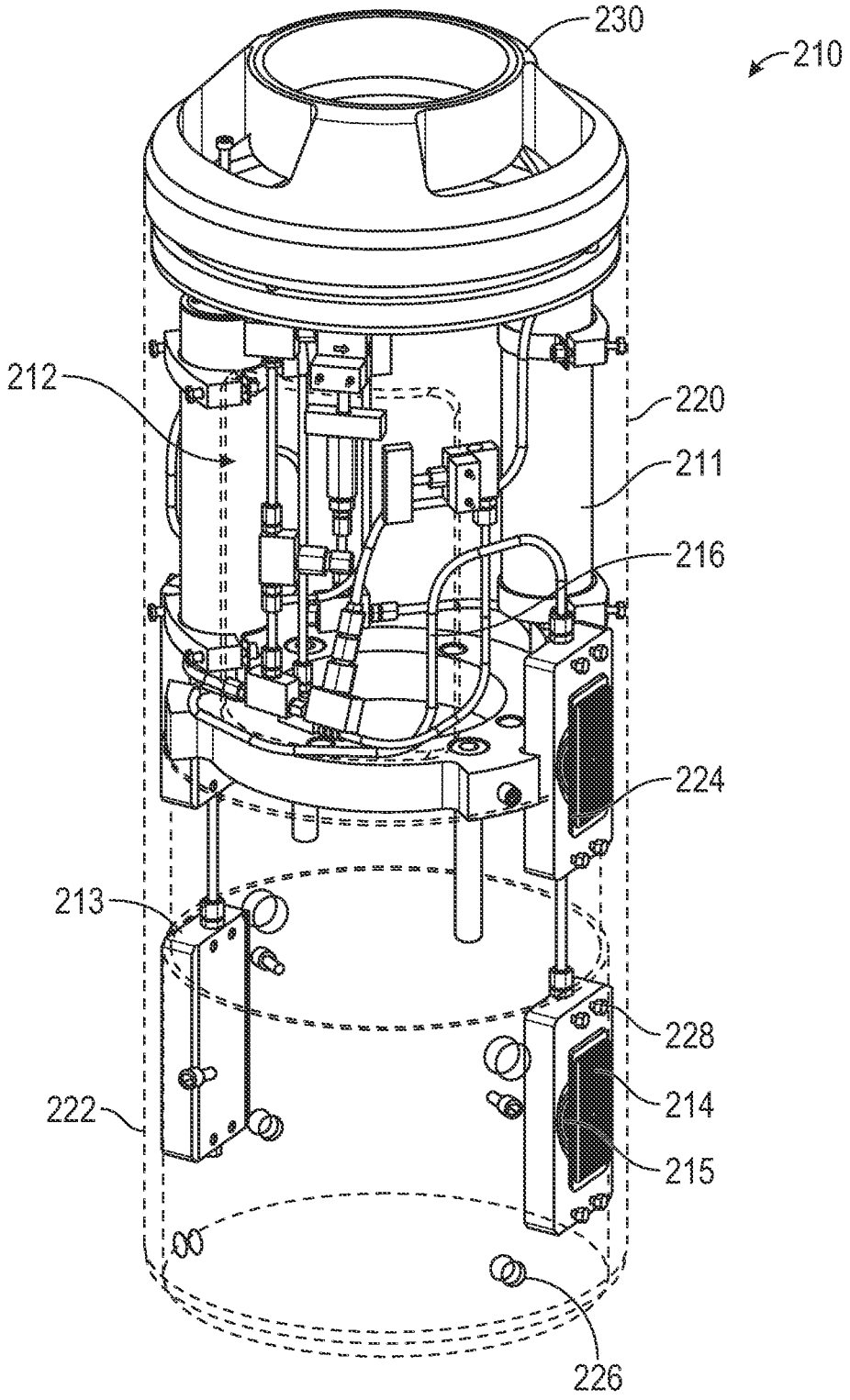
FIG. 3 shows a lead impression assembly assembled to an outer sleeve according to embodiments of the present disclosure.

FIG. 3 shows a perspective view of a lead impression assembly 210 mounted to the interior of an outer sleeve 220 according to embodiments of the present disclosure, where the outer sleeve 220 is shown as transparent in order to view the configuration of the lead impression assembly 210 therein. The outer sleeve 220 and the top bumper 230 protect the internal components of the lead impression assembly 210, including, at least one accumulator 211, at least one piston 212, at least one lead impression module 213 having a lead pad 214 and springs 215, and a plurality of conduits 216 fluidly connecting the components of the lead impression assembly 210. The outer sleeve 220 includes a wall 222 extending circumferentially around the lead impression assembly 210 and at least one window 224 formed through the wall 222. The lead pads 214 of each lead impression module 213 may be aligned with the windows 224 in the outer sleeve 220. Further, the outer sleeve 220 may include a plurality of holes 226, 228 formed through the wall 222 that may be used for attachment. For example, holes 226 may have screws or bolts extended therethrough and into a downhole tool for securing the outer sleeve 220 to the downhole tool. Holes 228 may have screws or bolts extended therethrough and into a receiving threaded hole formed in a component of the lead impression assembly 210 to secure the lead impression assembly 210 to the outer sleeve 220.

Figure 4A:
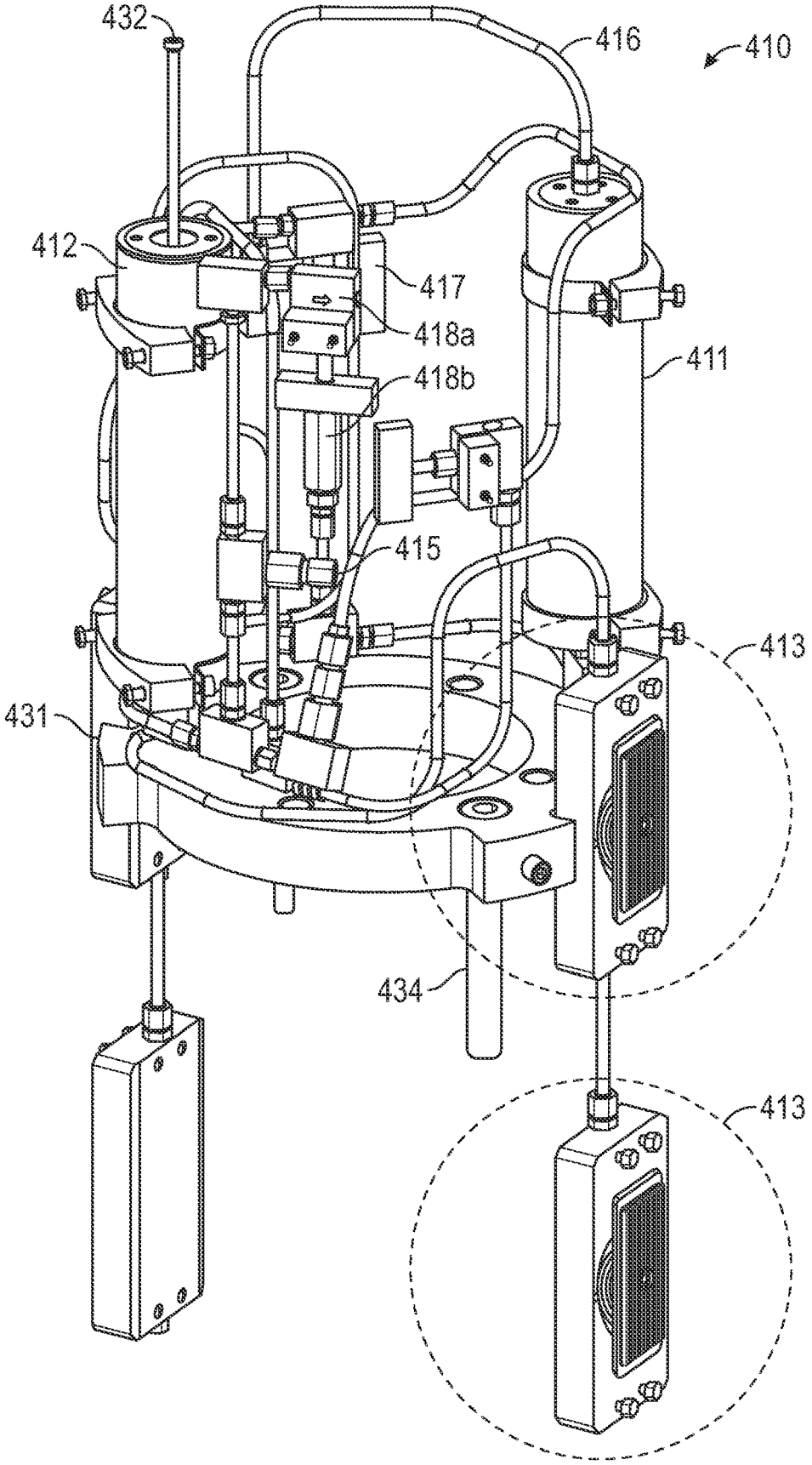
FIGS. 4A-C show a deconstructed view of a lead impression system according to embodiments of the present disclosure.
Figure 4B:
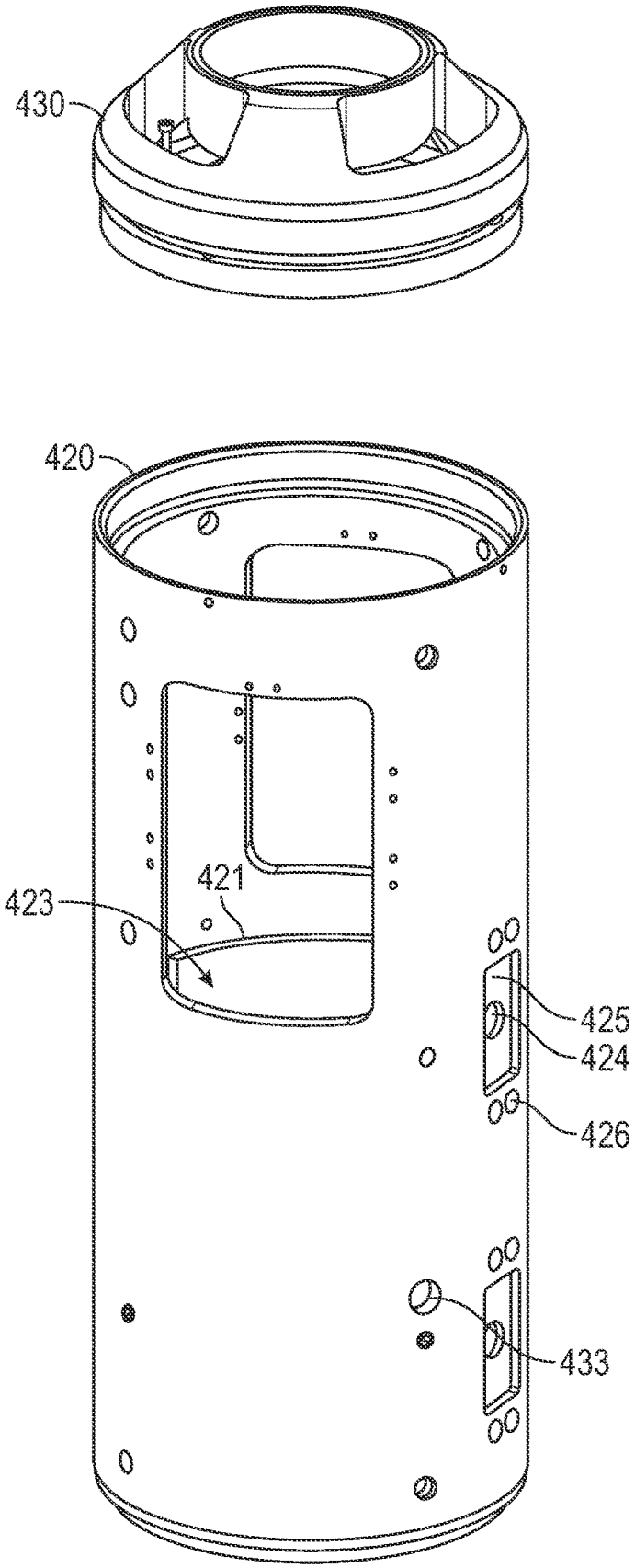

FIG. 4A shows a lead impression assembly separate from an outer sleeve 420 and a top bumper 430. FIG. 4B shows the top bumper 430 and the outer sleeve 420 including a sleeve mounting interface 421, which in the embodiment shown is a ledge formed around the entire circumference of the outer sleeve's inner surface. The sleeve mounting interface 421 may have an inner diameter that is less than that of the remaining inner surface 423 of the sleeve, such that the mounting interface 421 protrudes radially inward from the adjacent portion of the sleeve inner surface. The outer sleeve 420 further includes windows 424 formed through the outer sleeve wall. The windows 424 may be sized and positioned around the sleeve 420 to correspond with lead impression modules 413 from the lead impression assembly 410. For example, a window 424 may be substantially the same size and shape as one or more components of a lead impression module 413, such that the one or more components of the lead impression module 413 may fit through the window 424. Further, one or more recesses 425 corresponding in shape with an outer surface of the lead impression modules 413 may be formed around each window 424, where the lead impression modules 413 may be partially fitted within the recess(es) 425 upon assembling the lead impression assembly 410 to the outer sleeve 420. Multiple holes 426 may also be formed through the outer sleeve wall, which may be used as through holes for screws or bolts to attach the outer sleeve 420 to the lead impression assembly 410 and/or a downhole tool.

In the embodiment shown in FIG. 4A, the lead impression assembly 410 includes an accumulator 411, a piston 412, a support plate 431, a piston indicator 432, a pressure relief device 415, multiple lead impression modules 413, and a plurality of conduits 416 and one or more valves 418*a*, 418*b* (collectively referred to as 418). In some embodiments, a lead impression assembly may include more than one accumulator, more than one piston, and one or more lead impression modules. The conduits 416 and valves 418 together form a fluid communication system that fluidly connects the components of the lead impression assembly 410. In some embodiments, as shown, the fluid communication system may also include a manifold 417, which may include conduits and valves built therein and may act as a junction for the flow of fluid between different components in the lead impression assembly 410.

In the embodiment shown, the support plate 431 is annularly shaped to conform with and support the components of the lead impression assembly 410 as shown in FIG. 4A. The support plate 431, disposed at a longitudinal location along a downhole tool where the lead impression modules 413 are arranged, holds the lead impression modules 413 in place and attenuates vibrations that may be caused during any kinds of downhole operations. This support plate 431 further protects the plurality of conduits 416 from bending due to vibrations of the lead impression modules 413. The support plate 431 can be fixed firmly by using screws through holes 433, or any other conventionally known attachment methods. The support plate 431 further includes fixing bars 434 that may be inserted into a downhole tool to further ensure the overall structural integrity of the lead impression assembly 410. In some embodiments, components of a lead impression assembly 410 may be fixed to an outer sleeve 420 without a support plate 431.

In the embodiment shown, the accumulator 411 is a gas accumulator. However, different accumulator types may be used, such as spring loaded accumulators, weight loaded accumulators, membrane accumulators, piston accumulators, or bladder accumulators. The accumulator 411 in the lead impression assembly 410 may include a cylindrical tank that is in a fluid communication with the fluid communication system of the lead impression assembly 400. The pressure of the accumulator 411 can be set, or pre-charged, to a pre-set pressure prior to sending the assembled lead impression assembly 410 on the downhole tool 400 downhole. As discussed in more detail below, the pre-charged accumulator 411 may be used to effect internal pressure changes within the lead impression assembly 410 in response to changes in external pressure downhole.

The fluid communication system (including the conduits 416 and valves 418) shown in FIG. 4A may have a hydraulic fluid that flows through the fluid communication system to the components of the lead impression assembly 410. The hydraulic fluid can be filled into and vented out from the lead impression assembly 410 by using a fill/vent valve 418*a*.

A piston 412 in the lead impression assembly 410 may include a piston head disposed within a bore of a piston chamber, wherein a first side of the piston head is in fluid communication with a port to a check valve 418*b* along a conduit 416 in the fluid communication system. In other embodiments, a lead impression assembly may include more than one piston and check valve pair. A second side of the piston head, opposite the first side of the piston head, may be exposed (either directly exposed or through an intermediary) to pressure external to the lead impression assembly 410, such as downhole external pressure. When external pressure increases relative to internal pressure within the lead impression assembly 410 (e.g., fluid pressure in the fluid communication system), the external pressure may push the piston head, which in turn may push fluid through the check valve 418*b*, thereby letting the hydraulic fluid in the piston 412 flow into the remaining fluid communication system of the lead impression assembly 410. The piston 412 may transfer fluid through the check valve 418*b* when the external pressure acting on the piston 412 is greater than the internal pressure on the other side of the check valve 418*b*. When the external pressure acting on the piston 412 is less than the internal pressure of the lead impression assembly 410, however, the check valve 418*b* may block backward flow of the hydraulic fluid into the piston 412. In this manner, the check valve 418*b* may maintain a unidirectional flow in a conduit 416 from the piston 412 to the remaining fluid communication system in the lead impression assembly 410.

The lead impression assembly 410 may further include a piston indicator 432 disposed on the second side of the piston to show where the piston head is displaced along the piston 412. More specifically, the piston indicator 432 shows how much fluid is within the piston 412 by showing how far the piston indicator 432 moved up or down along the piston.

The external pressure acting on the piston is determined by the external pressure around the lead impression assembly 410. When the lead impression assembly is sent downhole on a downhole tool, an operator may increase and bleed down the external pressure downhole in order to perform a downhole operation, which may also act to concurrently take a lead impression with the attached lead impression assembly. For example, a lead impression assembly may be sent downhole on a single trip downhole tool to set an annulus seal assembly, which isolates the pressure of the production line from the annulus between the production line and the host casing. When the external pressure downhole is increased to set the annulus seal assembly, one or more pistons in the lead impression assembly 413 mounted around the single trip tool may push hydraulic fluid through one or more check-valves and into other components of the lead impression assembly 413, which increases the internal pressure of the lead impression assembly 413. The lead impression module(s) within the lead impression assembly 413 may experience the increased internal pressure from the hydraulic fluid that exerts higher force on a lead pad in the lead impression assembly 413.

Figure 4C:
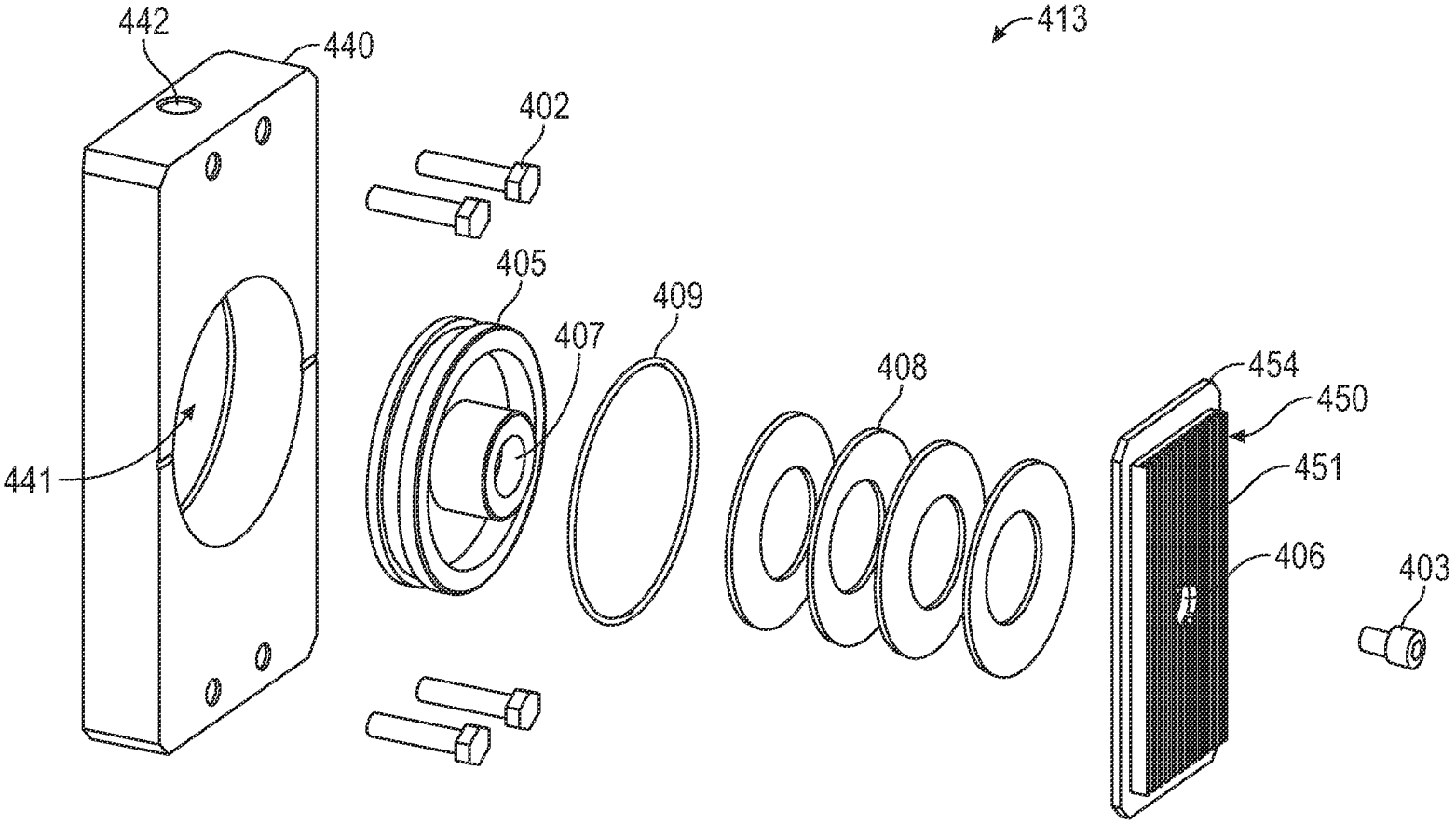

After a downhole tool operation, such as setting an annulus seal assembly, the external pressure may be bled down and a pressure differential is created between the external and the internal pressure of the assembly. When the external pressure is bled down, the lead pad in a lead impression assembly 413 protrudes radially outward to take a lead impression, and when the pressure differential increases to a designed burst pressure, the pressure relief device 415 may activate and relieve the internal pressure, which serves to bring the internal and external pressures into equilibrium, allowing the springs in the lead impression assembly 413 to retract the protruded lead pad. Other embodiments may have different types of pressure relief mechanisms. For example, the pressure relief device 415 in the embodiment shown is a pressure relief valve or a burst valve FIG. 4C shows a deconstructed perspective view of the lead impression module 413 shown in FIG. 4A. The lead impression module 413 includes a body 440 including a conduit 442 that is in fluid communication with the plurality of conduits of the lead impression assembly. A cavity 441 is created to correspond to a shape of a piston module 405 that slides along the cavity 441. The piston module 405 is sealed by using a seal ring 409 which prevents any leak of fluid from the cavity 441 to the lead pad 450. The springs 408 shown in FIG. 4C are Belleville springs assembled in series and stacked concentrically on and around a protrusion 407 in the piston module 405. Other types of springs may be used, and other configurations of springs around the lead pad may be used to provide a symmetrical distribution of force around the lead pad. According to embodiments of the present disclosure, the springs 408 may be made of stainless steel (e.g., 316 stainless steel) or any other suitable material.

Multiple screws 402 or other attachment mechanisms, which may be used to attach the lead impression module 413 to an outer sleeve (such as shown in FIG. 3) may be used to attach the body 440 onto an outer sleeve. According to embodiments of the present disclosure, a lead impression assembly may be mounted directly to an outer sleeve through attachment mechanisms including but not limited to socket head cap screws, hex head cap screws, crimping, welding, or anything alike. For example, the lead impression module 413 may be mounted directly to an outer sleeve by screwing socket head cap screws in holes on the outer sleeve that are aligned with the holes on the lead impression module 413.

Figure 5A:
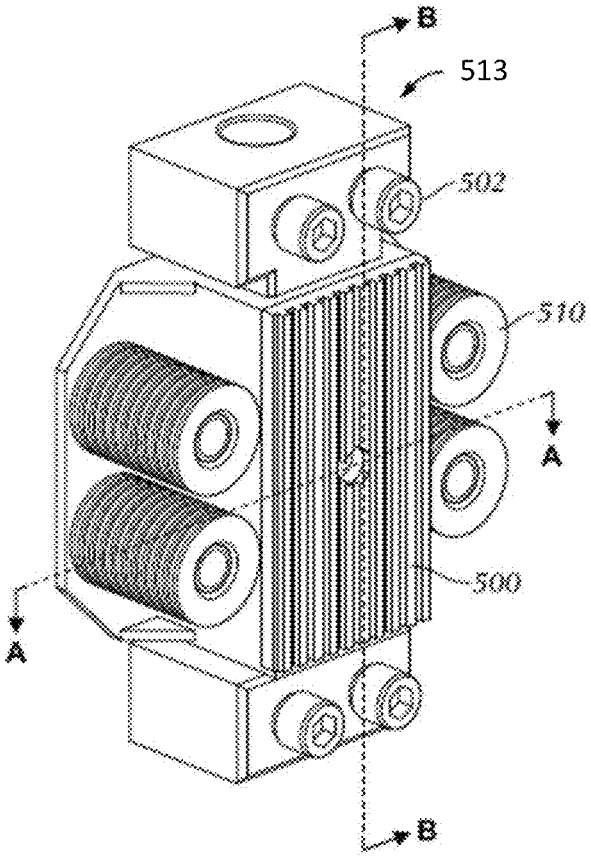
FIGS. 5A-B show a perspective view and a cross-sectional view of a lead impression module according to embodiments of the present disclosure.

The lead pad 450 in FIG. 5A may have a plurality of parallel ridges or other patterned surface geometry formed at its outer surface 451, which may provide a relatively weaker structural interface for crushing into a target surface. The lead pad 450 may be removably attached, for example, using a screw 403, to a base 454. By removably attaching the lead pad 450 to the base 454, the lead pad 450 may be removed from the lead impression module 413 (e.g., after an impression is taken), and a new lead pad may be attached to the base 454, thereby allowing reuse of the lead impression module 413. However, in other embodiments, a lead pad 450 may be fixedly attached or integrally formed with a base having at least one hole 406 and a screw 403.

A piston module 405 shown in FIG. 4C may act like a piston head that may slide along the cavity 441 in response to forces acting on a side of the piston module 405. More specifically, the body 520 of the lead impression module 413 may have at least one conduit 442 formed therethrough, where the conduit(s) 442 is in fluid communication with a piston module 405 that moves along a cavity 441 in the body 440. The cavity 441 shown in the embodiment of FIG. 4C is cylindrical to correspond to the shape of the piston module 405. The cavity 441 may vary in shapes depending on the configuration of the piston module 405. A seal ring 409 may be provided between the module 405 and the body 440, for example, by one or more O-rings, sealant, and/or surface-to-surface seal between the protrusion and surrounding channel, in order to seal fluid in the conduit 442 from escaping out of the lead impression module 413. The conduit (s) 442 formed through the lead impression module body 440 may also be in fluid communication with the fluid communication system of a lead impression assembly, such that changes in the internal pressure of the fluid communication system may exert varying forces on the piston module 405. Depending on, for example, the configuration of the conduit 442, materials of the body 440 of the lead impression module 413, and seal between the body 440 and base 454, a pressure capacity of such body 440 may range, for example, between 15 and 30 ksi.

Figure 4D:
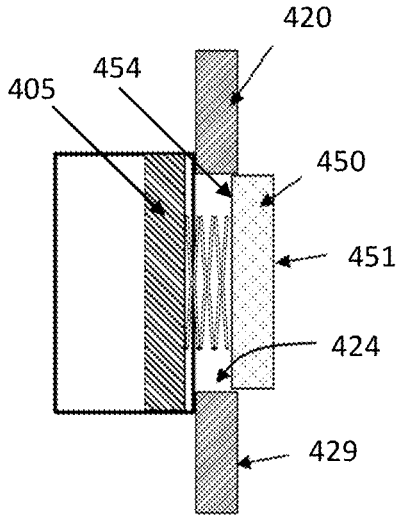
FIGS. 4D-E show a cross-sectional view of the operation of the lead impression module shown in FIG. 4C.
Figure 4E:
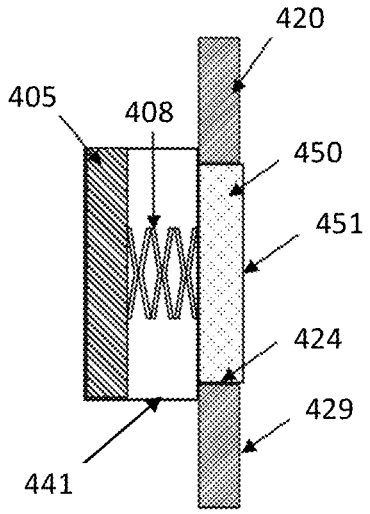

FIGS. 4D and 4E show partial cross-sectional views of the lead impression module 413 operating under different pressures. When the internal pressure in the fluid communication system (including conduit 442) is increased and the external pressure is bled down, fluid pressure from conduit 442 may apply a force to the base 454 of the lead pad 450 through springs 408. The springs 408 arranged on the piston module 405 allows the internal pressure of the conduit 442 to be applied to the base 454, and the reaction force from the spring 408 may push the base 454 and the lead pad 450 radially outward to a protracted position, as shown in FIG. 4D. In order to retrieve the lead pad 450, the internal pressure can be decreased, where the piston module 405 may move radially inward toward the base of the cavity 441 in the body 440, as shown in FIG. 4E, to a retracted position. For example, FIG. 4E shows a cross-sectional diagram of the lead impression module 413 in its original position where the internal pressure in the fluid communication system is lower than the external pressure, and the internal pressure does not move the piston module 405 or compress the springs 408. The outer surface 451 of the lead pad 450 also stays within the outer surface 429 of the outer sleeve wall 420 such that the lead pad 450 is within a window 424 formed in the wall of an outer sleeve 420. FIG. 4D shows the lead impression module 413 in a protracted position, where the piston module 405 is pushed outward due to an increased in the internal pressure. The piston module 405 then compresses the springs 408 against the base 454, which pushes the lead pad 450 outwardly and allows the lead impression module to take the lead impression of the environment.

Lead impression modules may have varying arrangements of components to protract a lead pad with relatively higher internal pressure in the lead impression assembly and retract the lead pad with relatively lower internal pressure in the lead impression assembly during changes in the external pressure. For example, FIGS. 5A-5D show another example of a lead impression module 513 according to embodiments of the present disclosure, where an increase in the internal pressure of the lead impression assembly relative to the external pressure may cause a lead pad to protract and take a lead impression, and a decrease in the internal pressure may cause the lead pad to retract.

Figure 5B:
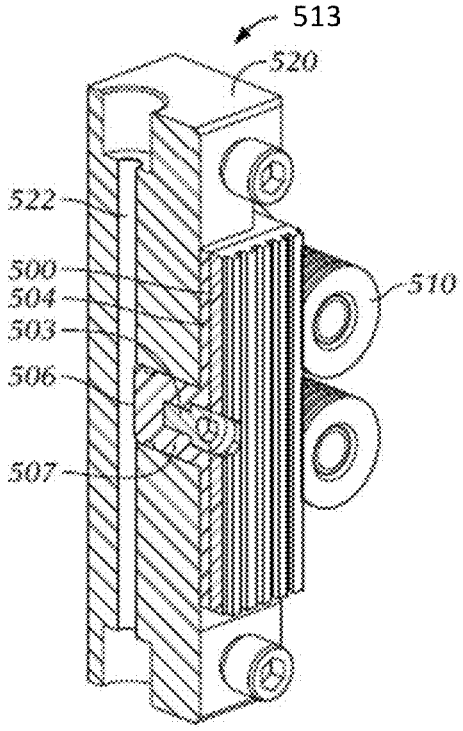

FIG. 5A shows a perspective view of the lead impression module 513, and FIG. 5B shows a cross-sectional view of the lead impression module 513 of FIG. 5A along line B. The lead impression module 513 includes a lead pad 500 disposed on a body 504, springs 510 arranged on opposite sides of the lead pad 500, and multiple screws 502 or other attachment mechanisms, which may be used to attach the lead impression module 513 to an outer sleeve (such as shown in FIG. 3). The lead pad 500 may be removably attached, for example, using a screw 503, to a base 504 having at least one load interface 506.

The body 520 of the lead impression module 513 may have at least one conduit 522 formed therethrough, where the conduit(s) 522 is in fluid communication with one or more load interfaces 506 of the base 504. The conduit(s) 522 formed through the lead impression module body 520 may also be in fluid communication with the fluid communication system of a lead impression assembly, such that changes in the internal pressure of the fluid communication system may exert varying forces on the load interface(s) 506 of the base 504. In the embodiment shown, the load interface 506 is a surface of the base 504 that is exposed to the flow path formed by the conduit 522 (and thus exposed to internal pressures in the conduit 522). Further, the load interface 506 is formed at an end of a protrusion 507 protruding from the base 504. The protrusion 507 may act like a piston that may slide through a channel in response to forces acting on either end.

In the embodiment shown, the springs 510 are also retained to the base 504 at areas of the base 504 that are separate from the portion of the base 504 to which the lead pad 500 is attached. In this manner, the springs 510 are connected to the lead pad 500 through the base 504, which may act as a mechanical connection for transfer of loads acting on the lead pad 500, the springs 510 and the load interfaces 506 of the base 504. For example, fluid through the conduit 522 may apply a load to one or more load interfaces 506 of the base 504, and the springs 510 may apply a counter force to the base 504. According to one or more embodiments, springs 510 may be arranged with respect to a lead pad 500 to provide an inward bias to counter any outward force on the lead pad 500 that may be present due to the pre-set pressure of the accumulator as well as to provide a retraction force for the lead pad 500. The springs 510 shown in FIGS. 5A-D are Belleville springs assembled in series and in four stacks positioned symmetrically on opposite sides of the lead pad 500 (with two pairs of equal spring stacks on opposite sides of the lead pad 500). However, other types of springs may be used, and other configurations of springs around the lead pad may be used to provide a symmetrical distribution of inwardly biasing force (from the springs) around the lead pad.

According to embodiments of the present disclosure, an accumulator of a lead impression assembly is set at a certain pressure prior to sending the system downhole. This pre-set pressure applies a force onto the base 504 and attached lead pad 500 through a load interface 506 in a protrusion 507.

Springs 510 may provide an inward bias to the lead pad 500 to keep the lead pad 500 in a retracted position. In other words, the springs 510 may provide a force that keeps the lead pad 500 in a radially inward, retracted position (relative to an outer sleeve or other protective wall) until operational loading forces overcome the bias from the springs 510 and push the lead pad 500 to a radially outward, projected position. Further, frictional forces from a seal between the base 504 and the body 520 of the lead impression module 513, which may seal fluid in the fluid communication system from escaping through the lead impression module 513, may contribute to forces holding the lead pad 500 in an initial retracted position. For example, frictional force from a seal between the piston module 531 and the body 520 of the lead impression module 513 may apply a force ranging from, for example, 40 lbf to 200 lbf (e.g., 60 lbf to 150 lbf, 80 lbf to 100 lbf, or other sub-ranges).

The springs 510 may be preloaded (e.g., under a load ranging from, for example, about 400 to 600 pounds-force) to oppose pressure from the pre-charge of a fluidly connected accumulator in the lead impression assembly, and hold the lead pad 500 in a retracted position. The springs 510 may be fully loaded under a load, for example, ranging from about 800 lbf to about 1200 lbf (including any sub-ranges thereof), which may expand the lead pad 500 into a protracted position.

According to embodiments of the present disclosure, the lead pad 500 may be radially and axially aligned with a window, such as shown in FIG. 3, where the lead pad 500 may extend radially outward at least partially through the window when changes in the internal pressure of the lead impression assembly provides loading forces large enough to overcome any frictional forces around the lead pad 500 and/or base 504 (e.g., frictional force between the lead pad 500 and an outer sleeve window in which the lead pad 500 is disposed and/or frictional force from the seal(s) between the base 504 and the lead impression module body 520), and other required forces necessary to crush the lead pad into a wellhead bore feature in order to obtain an intelligible lead impression.

Figure 5C:
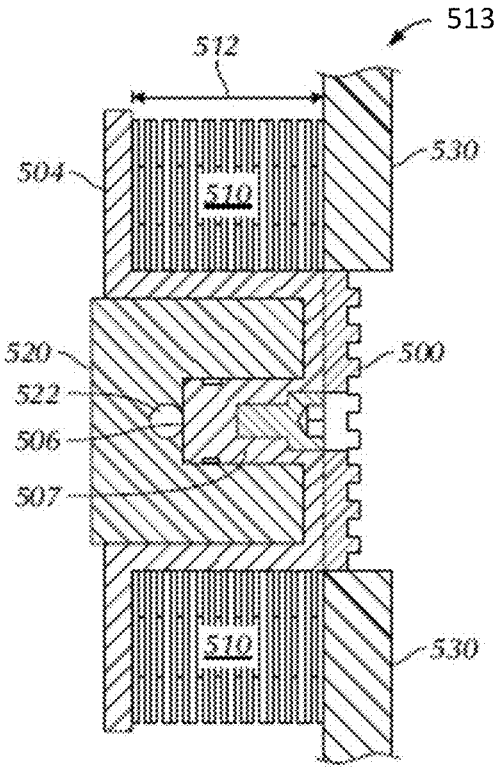
FIGS. 5C-D show a cross-sectional view of the operation of the lead impression module in FIGS. 5A-B.
Figure 5D:
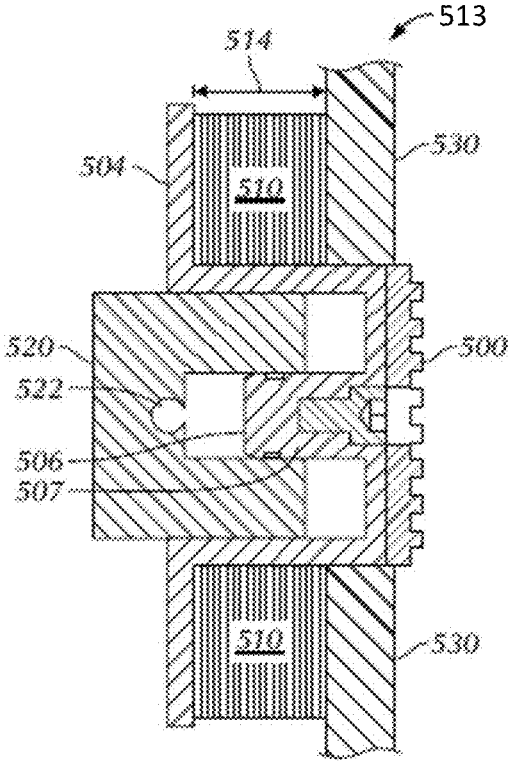

FIGS. 5C and 5D show operational diagrams of the lead impression module 513 shown in FIGS. 5A and 5B, along the cross-section A shown in FIG. 5A. FIG. 5C shows the lead pad 500 in a retracted position, and FIG. 5D shows the lead pad 500 in a protracted position. The cross sectional view of the lead impression module 513 shows the base 504 having the lead pad 500 attached on an outer surface, the springs 510 attached at oppositely projecting sides, and the protrusion 507 extending through the channel 508 formed in the body 520 of the lead impression module 513, where the channel 508 is in fluid communication with the conduit 522 formed transversely through the body 520.

In the retracted position, the springs 510 may be preloaded to be compressed between the oppositely projecting sides of the base 504 and a wall 530 (e.g., a wall of an outer sleeve). The pre-load may be applied, for example, by compressing the springs between the base 504 and wall 530 under enough force to counter pressure applied to the base protrusion 507 through conduit 522, where the pressure applied through conduit 522 may be a pre-set pressure generated from at least one accumulator in fluid communication with the fluid communication system (including conduit 522) of the lead impression assembly. In the retracted position, the springs 510 may extend a length 512.

When the internal pressure in the fluid communication system (including conduit 522) is increased and the external pressure is bled down, fluid pressure from conduit 522 may apply a force to the load interface 506 formed at an end of the protrusion 507. The force may push the protrusion 507, and thus base 504 and attached lead pad 500, radially outward to a protracted position. The force from the increased internal pressure further compresses the springs 510 between the wall 530 to a length 514, where the length 514 of the springs 510 when the lead pad 500 is in protracted position is less than the length 512 of the springs 510 when the lead pad 500 is in retracted position.

According to embodiments of the present disclosure, a lead impression assembly may be assembled by fluidly connecting at least one accumulator to a fluid communication system in the lead impression assembly, where the accumulator is pre-charged to a pre-set pressure, and where the internal pressure within the fluid communication system is equalized with the pre-set pressure. The pre-set pressure applies a force on at least one lead pad (e.g., indirectly via the base on which the lead pad is attached, as shown in FIGS. 5C and 5D), while a spring force and/or frictional forces around the lead pad may provide an opposing force large enough to keep the lead pad in a retracted position (e.g., such that the lead pad does not protrude entirely through a window formed in a protecting outer sleeve). For example, referring again to FIGS. 5C and 5D, frictional forces from the seal between the base protrusion 507 and the channel 508 may oppose the fluid force from fluid within conduit 522. Thus, when the internal pressure of a lead impression assembly is equalized with the pre-set pressure of an accumulator in the lead impression assembly, one or more lead pads in the lead impression assembly may be held in a retracted position by springs and/or friction. According to embodiments of the present disclosure, lead pads may be held in the retracted position primarily by an internal/external pressure balance (where external pressure may act on the lead pads to keep them retracted as well as simultaneously acting on the piston to charge the accumulator). The springs may primarily be used to return the lead pads to the retracted position, and may also oppose outward radial force due to internal pressure.

Figure 6:
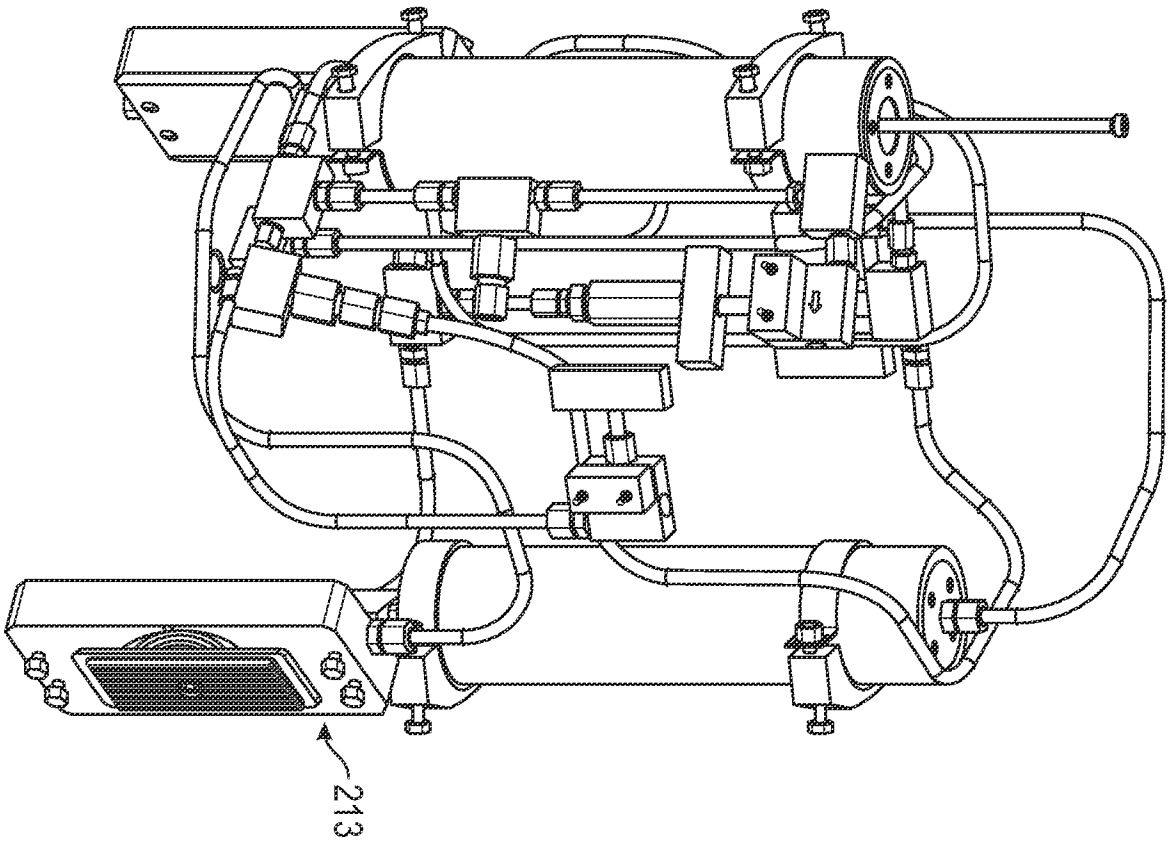
FIG. 6 shows a lead impression assembly according to embodiments of the present disclosure.
Figure 7:
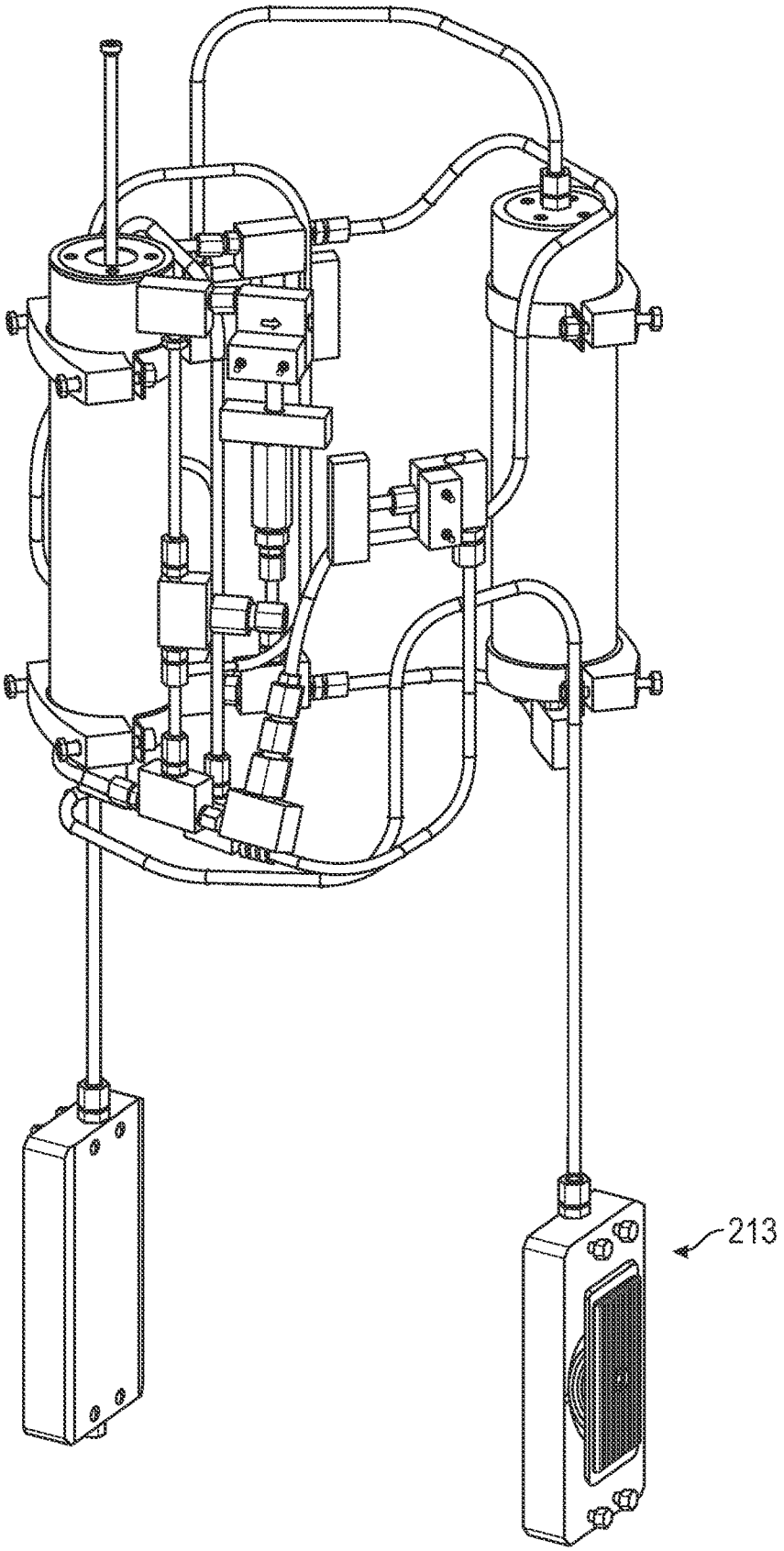
FIG. 7 shows a lead impression assembly according to embodiments of the present disclosure.
Figure 8:
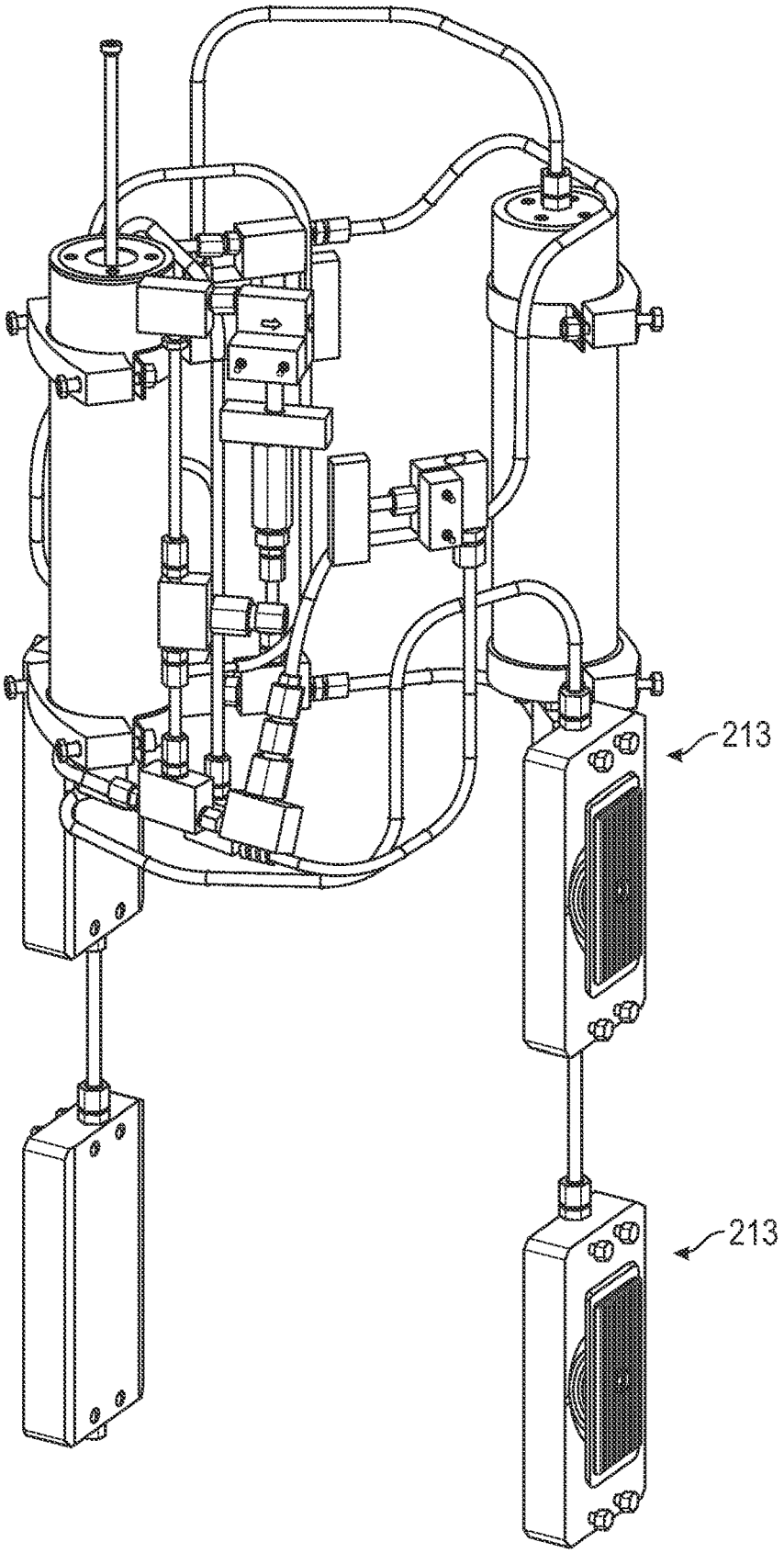
FIG. 8 shows a lead impression assembly according to embodiments of the present disclosure.

According to embodiments of the present disclosure, lead impression modules 213 can be positioned at different axial and circumferential locations around an outer sleeve 220 to take one or more lead impressions at different axial and circumferential locations downhole. As a non-limiting example, a pair of the lead impression modules 213 may be located at a first axial position and another pair of the lead impression modules 213 may be located at a second axial position, as shown in FIG. 8. Further, in some embodiments, lead impression modules 213 may be axi-symmetrically positioned around different circumferential locations as shown in FIGS. 6 and 7. By positioning multiple lead impression modules 213 at different axial and/or circumferential locations with respect to a downhole tool to which the lead impression assembly is mounted, lead impressions at multiple downhole locations may be taken at a single time. One skilled in the art would appreciate how using multiple lead impression modules instead of a single lead impression module would provide several lead impression data in order to easily determine a location of the downhole tool at the time the impression was made.

Methods of taking lead impressions according to embodiments of the present disclosure may include sending an actuatable assembly to a downhole location, changing an external pressure downhole around the actuatable assembly at the downhole location, and using the changing external pressure downhole to initiate taking a lead impression with the actuatable assembly. An external pressure around an actuatable assembly refers to the pressure adjacent to and surrounding the actuatable assembly, such that the external pressure is in direct or indirect contact with one or more pistons in the actuatable assembly.

When the external pressure around an actuatable assembly is increased, the internal pressure of the actuatable assembly may also increase (e.g., whereby external pressure may apply pressure to one or more pistons in the actuatable assembly, which in turn may proportionally increase the internal pressure of the other side of the piston(s)). When the external pressure around the actuatable assembly decreases relative to the internal pressure of the actuatable assembly (and a pressure differential is formed between the internal pressure of the actuatable assembly and the external pressure), one or more radially expandable elements, such as a slip or lead pad, in the actuatable assembly may protrude radially outward in a protracted position. For example, the actuatable assembly may be a lead impression assembly 210 such as shown in FIG. 3, where the lead pads 214 may protrude radially outward in a protracted position when the external pressure around the lead impression assembly 210 decreases relative to the internal pressure of the lead impression assembly (and a pressure differential is formed between the internal pressure of the lead impression assembly and the external pressure). One skilled in the art will appreciate how lead impression systems disclosed herein may perform an annulus seal assembly setting and lead impressions in one single trip.

For example, an actuatable assembly according to embodiments of the present disclosure may be assembled around a downhole tool and within an outer sleeve, such that one or more lead pads of the actuatable assembly may be aligned with window(s) formed in the outer sleeve. The lead impression system may be sent downhole to perform an annulus seal assembly setting (or other downhole operation). When the external pressure around the lead impression system is increased to perform the seal setting or other downhole operation, the increased external pressure may also increase the internal pressure within the actuatable assembly. An operator may bleed down the external pressure once the annulus seal assembly setting (or other downhole job) is complete. When the external pressure is bled down, lead pad(s) in the actuatable assembly may protrude radially exterior to an outer surface of the outer sleeve window(s) such that the lead pad extends outwardly from the window. When the lead pad extends outwardly from the window, the lead pad may contact an interior surface of a downhole or well component, such as a well casing, in order to take an impression of a surface of the component. For example, the lead pad may take an impression of the surface of a host casing by imprinting the surface features of the hanging areas of a host casing.

A detailed description of an example of a process for taking a lead impression according to embodiments of the present disclosure is provided below with reference to the schematics shown in FIGS. 9-12. Like reference numerals are used in each of FIGS. 9-12 to designate like components.

Figure 9:
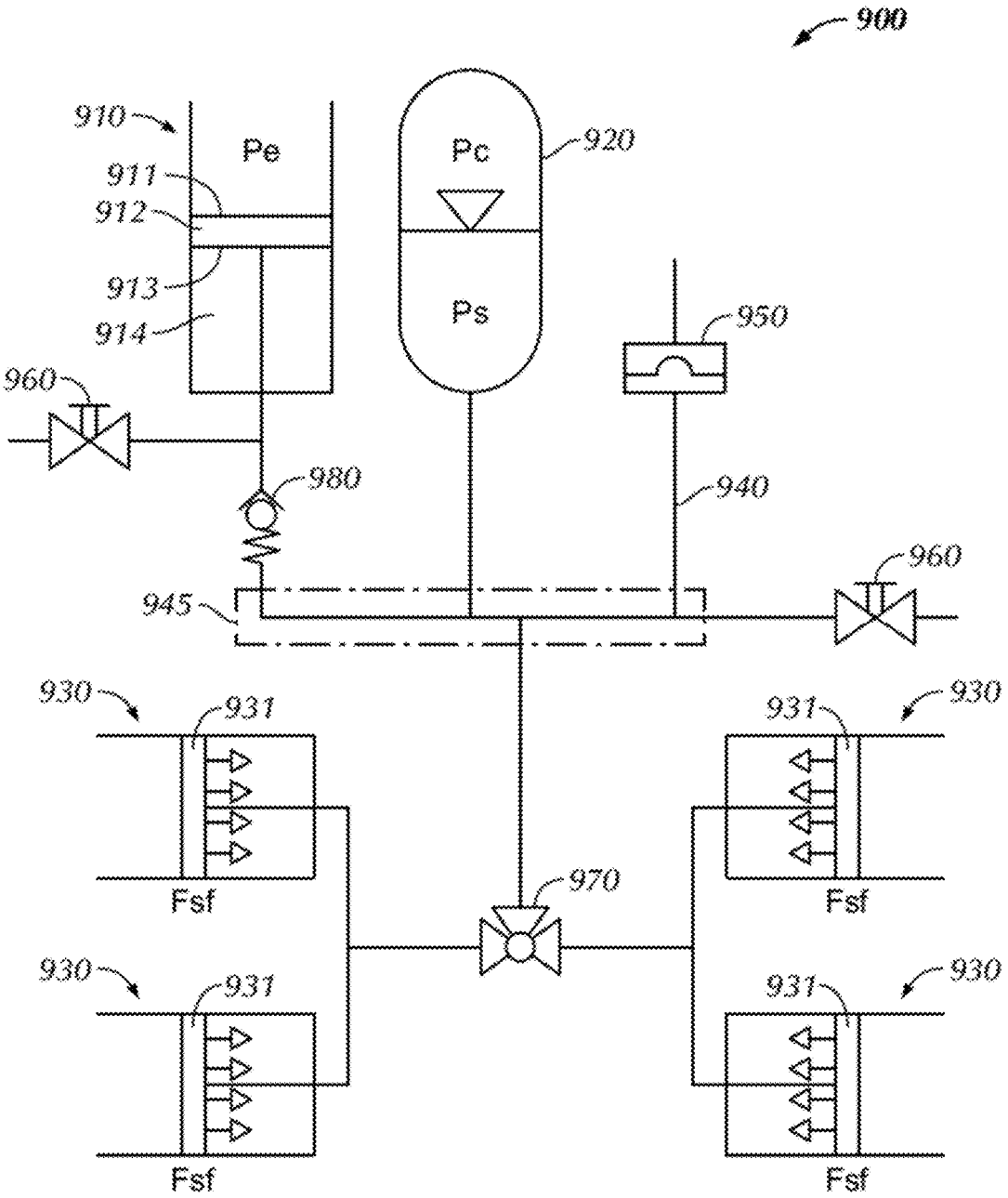
FIG. 9 shows a schematic representation of an actuatable assembly according to embodiments of the present disclosure.

FIG. 9 is a schematic view of an actuatable assembly 900 according to embodiments of the present disclosure. The actuatable assembly 900 includes a piston 910, an accumulator 920, and multiple lead impression modules 930*a*, 930*b*, 930*c*, 930*d* (collectively referred to as 930) in fluid communication with each other through a plurality of conduits 940, where the plurality of conduits 940 may form a fluid communication system. The conduits 940 may branch from a manifold 945 to different components in the actuatable assembly 900. Conduits 940 may be made of materials with high strength and high resistance to corrosion, such as but not limited to nickel-chromium alloy 625.

One or more valves (e.g., 950, 960, 970 and 980) may further be positioned along the conduits 940 to control fluid flow through the fluid communication system. For example, a three-way valve 970 (e.g., a 3-way switching ball valve) may be positioned at a junction between conduits 940 connecting the lead impression modules 930 to the manifold 945. The three-way valve may be used to selectively direct fluid to one or more of the lead impression modules 930 while preventing fluid flow to one or more other of the lead impression modules 930.

A check valve 980 may be positioned along a conduit 940 branching from the manifold 945 to the piston 910. The check valve 980 may be oriented to allow fluid flow in a direction from the piston 910 into the manifold 945 and prevent back flow of fluid in a direction from the manifold 945 to the piston 910.

The actuatable assembly 900 may further include at least one pressure relief device 950, which may be selected/designed to have a selected burst pressure, at which pressure the pressure relief device 950 activates and relieves internal pressure within the actuatable assembly 900. In some embodiments, the pressure relief device 950 may include a burst disc that is ruptured when a pressure differential between the external pressure and the internal pressure of the actuatable assembly 900 exceeds the burst pressure. At least one vent/fill valve 960 may be positioned at an opening to one or more conduits 940 to fill and/or vent fluid from the actuatable assembly. In the embodiment shown, a vent/fill valve 960 may be positioned upstream of the check valve 980, such that fluid may be filled into the fluid communication system between the piston 910 and the check valve 980.

The piston 910 includes a piston head 912 disposed within a bore of a piston chamber 914. A first side 911 of the piston head 912 is exposed to the external environment (e.g., a downhole environment) of the actuatable assembly 900, and thus may have an external pressure, Pe, of the external environment applied thereto. A second side 913 of the piston head 912 (opposite the first side 911) is in fluid communication with the fluid communication system, and thus also in fluid communication with the other components of the actuatable assembly 900, such as the accumulator 920 and the lead impression modules 930.

As shown in FIG. 9, the actuatable assembly 900 may have an accumulator 920 pre-charged to a pre-set pressure, Pc. Fluid may be filled into the fluid communication system via a vent/fill valve 960 and have a system internal pressure, Ps. Further, spring and frictional forces, Fsf, may hold lead pads 931 within the lead impression modules 930 in a retracted position, as described above.

Figure 10:
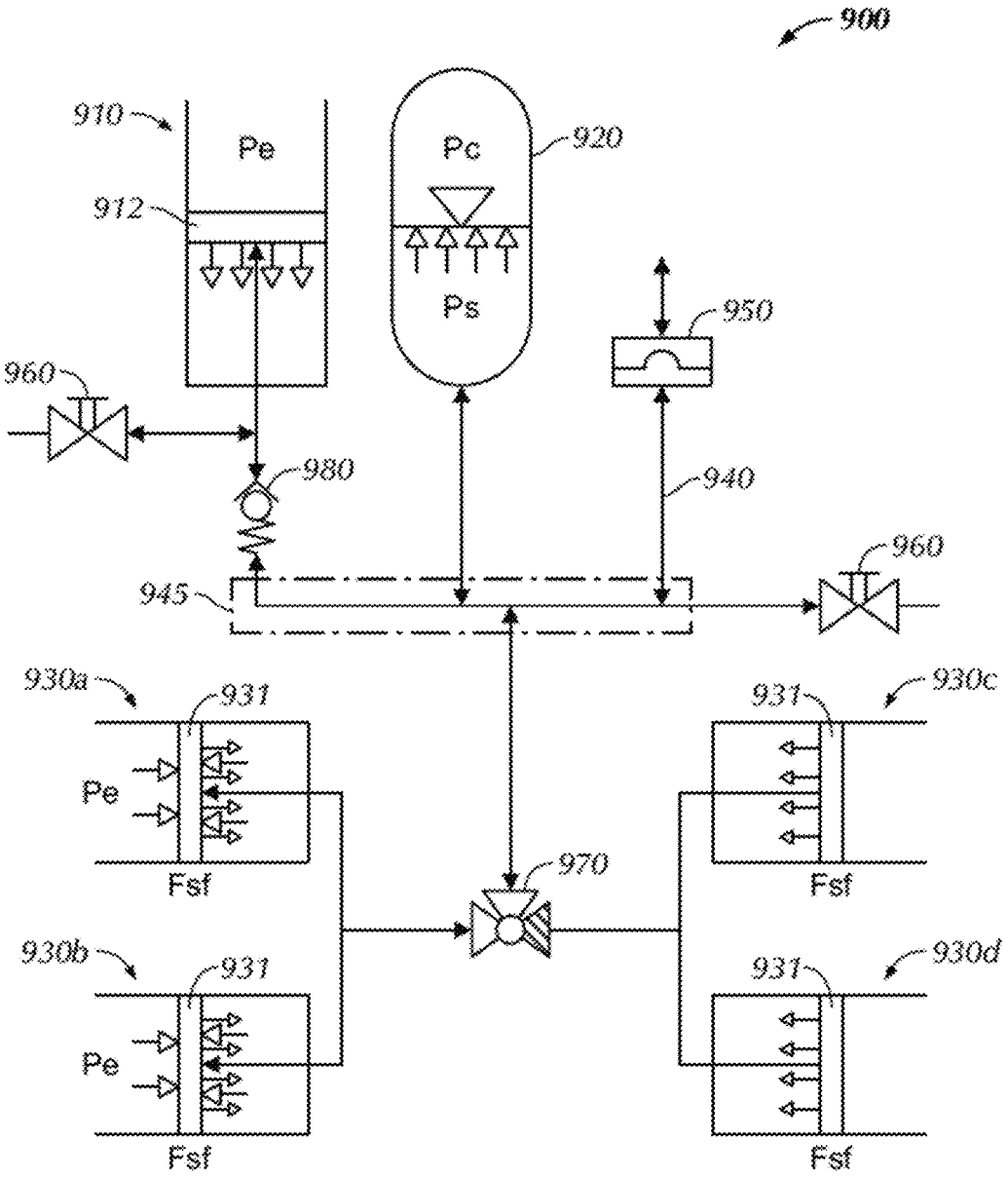
FIG. 10 shows a schematic representation of the actuatable assembly in FIG. 9 in a first step of an operation according to embodiments of the present disclosure.

FIG. 10 shows the actuatable assembly 900 in a first step of an operation, where the three-way valve 970 is in a first position, allowing fluid flow between the manifold 945 and lead impression modules 930*a*, 930*b* and blocking fluid flow to lead impression modules 930*c*, 930*d*. As external pressure Pe is increased, the piston 910 acts on the fluid communication system, displacing fluid across the check valve 980. As fluid moves across the check valve 980 into the fluid communication system, the system internal pressure Ps increases. In such manner, the increase in internal pressure Ps may correlate to the increase in external pressure Pe. Further, as fluid moves into the fluid communication system, the fluid moves into the fluidly connected accumulator 920, compressing the pre-charged volume within the accumulator 920, and thus increasing the accumulator pressure Pc which correlates to the increase in external pressure. In the first step, the lead pads 931 within the lead impression modules 930 are maintained in their retracted positions by a pressure balance between Pe and Ps as well as spring force and seal friction resisting outward radial motion.

According to embodiments of the present disclosure, the external pressure Pe around the actuatable assembly 900 may be increased in the course of performing another downhole operation (e.g., while sealing around a downhole tool on which the actuatable assembly is attached, the external pressure may be increased above the tool when setting and/or testing the seal), or alternatively, may be increased for the sole purpose of taking a lead impression. As the external pressure Pe is increased, the external pressure Pe, internal pressure Ps, and accumulator pressure Pc may equalize. Thus, in the first step shown in FIG. 10, the external pressure Pe, internal pressure Ps, and accumulator pressure Pc may be equal (Pe=Ps=Pc).

Figure 11:
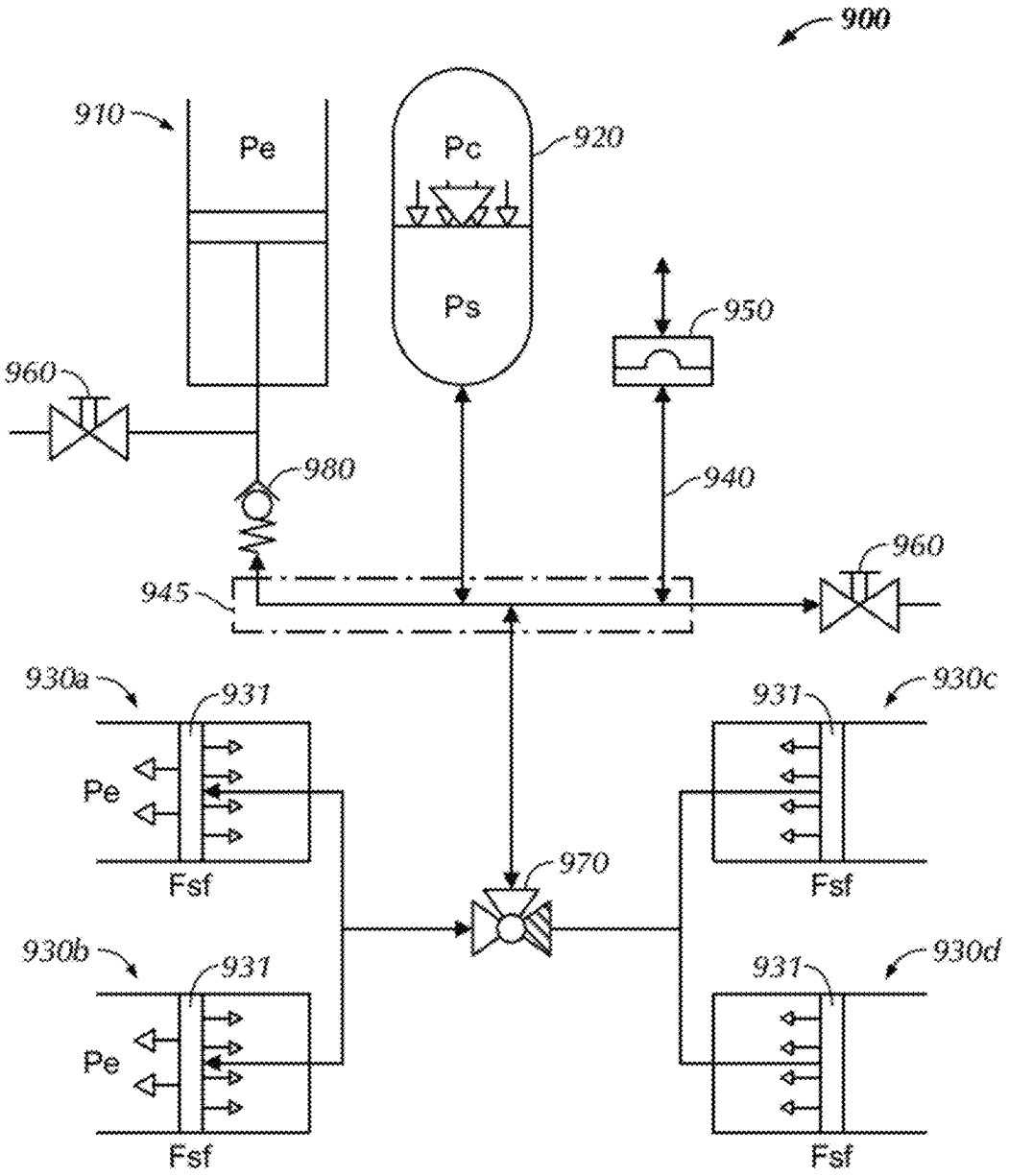
FIG. 11 shows a schematic representation of the actuatable assembly in FIGS. 9 and 10 in a second step of the operation according to embodiments of the present disclosure.

FIG. 11 shows the actuatable assembly 900 in a second step of the operation, where the external pressure Pe is decreased (e.g., when bleeding the pressure from above a downhole tool after setting and/or testing a seal). As external pressure Pe is bled, a pressure differential is created across the lead pads 931 in the lead impression modules 930*a*, 930*b* and across the pressure relief device 950. The check valve 980 may prevent fluid flow from flowing back out of the fluid communication system into the piston chamber. In such manner, the pressure differential is in part created by trapping pressure build up in the fluid communication system.

From the pressure differential generation, the lead pads in the lead impression modules 930*a*, 930*b* begin to expand (or radially protrude) as the force exerted by the internal pressure Ps increases past the spring and seal friction forces Fsf. Further, as the pressure differential increases between the system internal pressure Ps and the environmental external pressure Pe, and as the lead pads 931 begin to move, the accumulator charge, e.g., a gas volume charged in the accumulator 920, begins to expand. In other words, as the external pressure Pe is reduced, the accumulator pressure Pc trapped from the previous charging acts on the fluid communication system. The resulting accumulator pressure Pc and internal pressure Ps decrease at a rate based on the size of the accumulator 920 and the volume displaced by the expansion of the lead pads 931. Thus, in the second step shown in FIG. 11, as the external pressure is decreased, the external pressure Pe is less than the system internal pressure Ps, the internal pressure Ps changes with the change in accumulator pressure Pc, and for a time, the pressure differential is less than the burst pressure Pb of the pressure relief device 950 ((Ps−Pe)<Pb), thereby allowing the lead pads 931 to expand into their protracted positions, as described above, and into a downhole surface (e.g., a casing profile) to take an impression.

Figure 12:
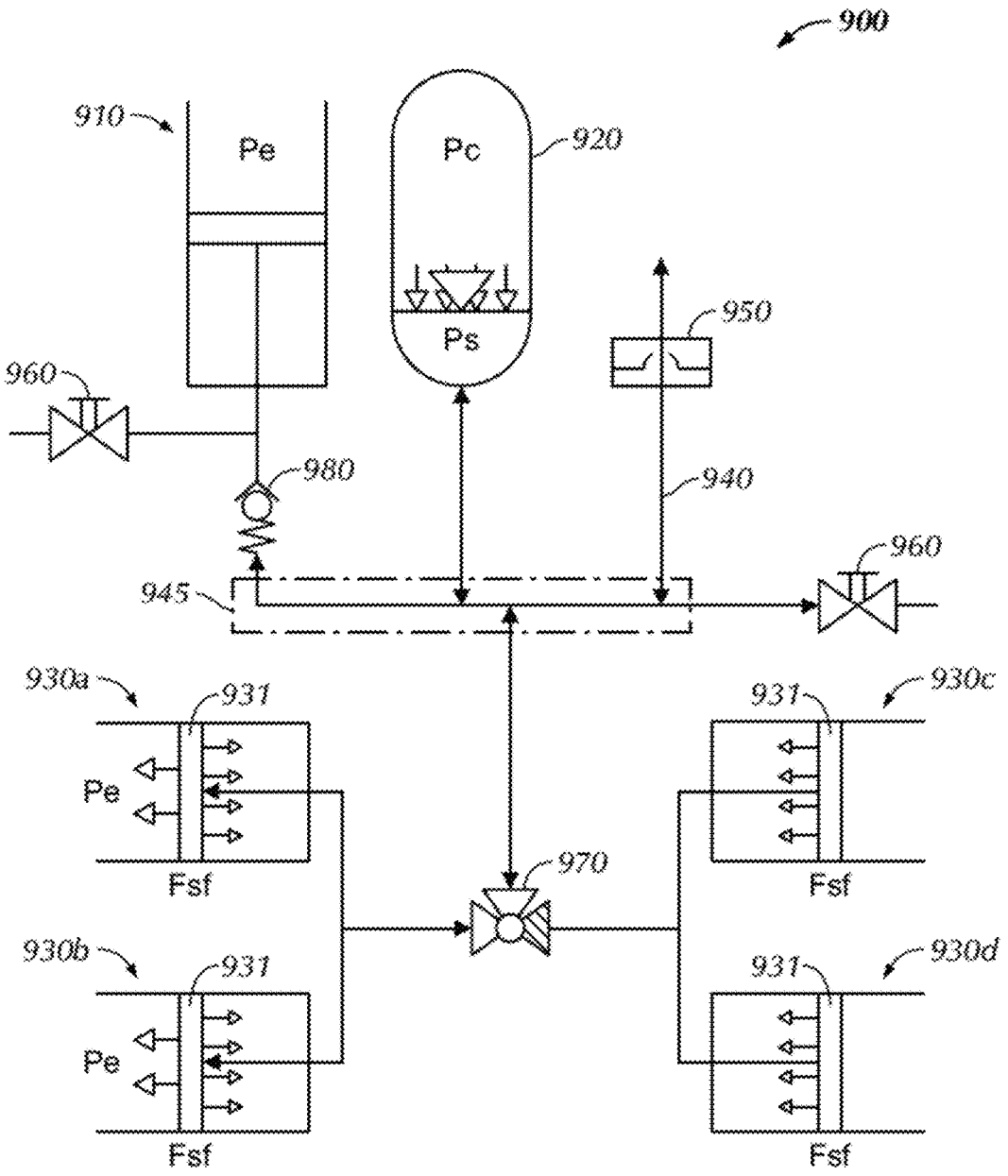
FIG. 12 shows a schematic representation of the actuatable assembly in FIGS. 9-11 in a third step of the operation according to embodiments of the present disclosure.

FIG. 12 shows the actuatable assembly 900 in a third step of the operation, whereas the external pressure Pe is continued to decrease, the pressure differential between the external pressure Pe and the internal pressure Ps exceeds the burst pressure Pb of the pressure relief device 950 ((Ps−Pe) >Pb). As the pressure differential increases past the burst pressure Pb, the disc in the pressure relief device 950 will be activated and the fluid communication system vented. When the pressure relief device 950 activates, the accumulator 920 will expand to its pre-charged state (where accumulator pressure Pc equals its pre-charged value). As the fluid communication system is vented and the internal pressure Ps decreases, the force due to internal pressure Ps exerted on the lead pads 931 decreases, thereby allowing the spring force to retract the lead pads 931 back to their retracted position. Ultimately, the internal pressure Ps and the external pressure Pe are equalized (Ps=Pe) and the lead pads 931 are fully retracted.

The three-way valve 970 shown in FIGS. 9-12 allows fluid communication between either of the two pairs of the lead impression modules 930*a*, 930*b* and 930*c*, 930*d* and the plurality of conduits 940 and valves in the fluid communication system. For example, the three-way valve 970 may allow fluid communication to a first pair of the lead impression modules 930*a*, 930*b* at a first position, positioned axially higher than a second pair of lead impression modules 930*c*, 930*d*. The operation schematically represented in FIGS. 10-12 may be repeated with the 3-way valve 970 switched in a different position to take lead impressions with lead impression modules 930*c*, 930*d* at the second position, positioned axially lower than the first pair, to perform lead impressions at the second position. The results of the lead impressions of the two pairs at different axial locations can be analyzed to locate where the downhole tool landed on a host casing.

Further, one skilled in the art may appreciate that a similar procedure described above with respect to FIGS. 10-12 may be used to take a lead impression with two, three, four, or more lead impression modules simultaneously by using a different configuration of 3-way valve(s) 970 and/or to take a lead impression with one lead impression module.

According to embodiments of the present disclosure, lead impression modules may be positioned axi-symmetrically around the downhole tool at certain axial positions. This may allow the actuatable assembly to take lead impressions at different circumferential positions around the downhole tool, e.g., on at least two different hanging areas on an interior circumference of the host casing. Alternatively, or additionally, multiple lead impression modules may be positioned at different axial positions along the downhole tool, e.g., as shown as the first position and the second position of the lead impression modules in FIG. 4A. This may allow the actuatable assembly to take lead impressions on at least two different hanging areas along the axis of the host casing. The surface features of the hanging area may be different depending on their axial positions.

Figure 13A:
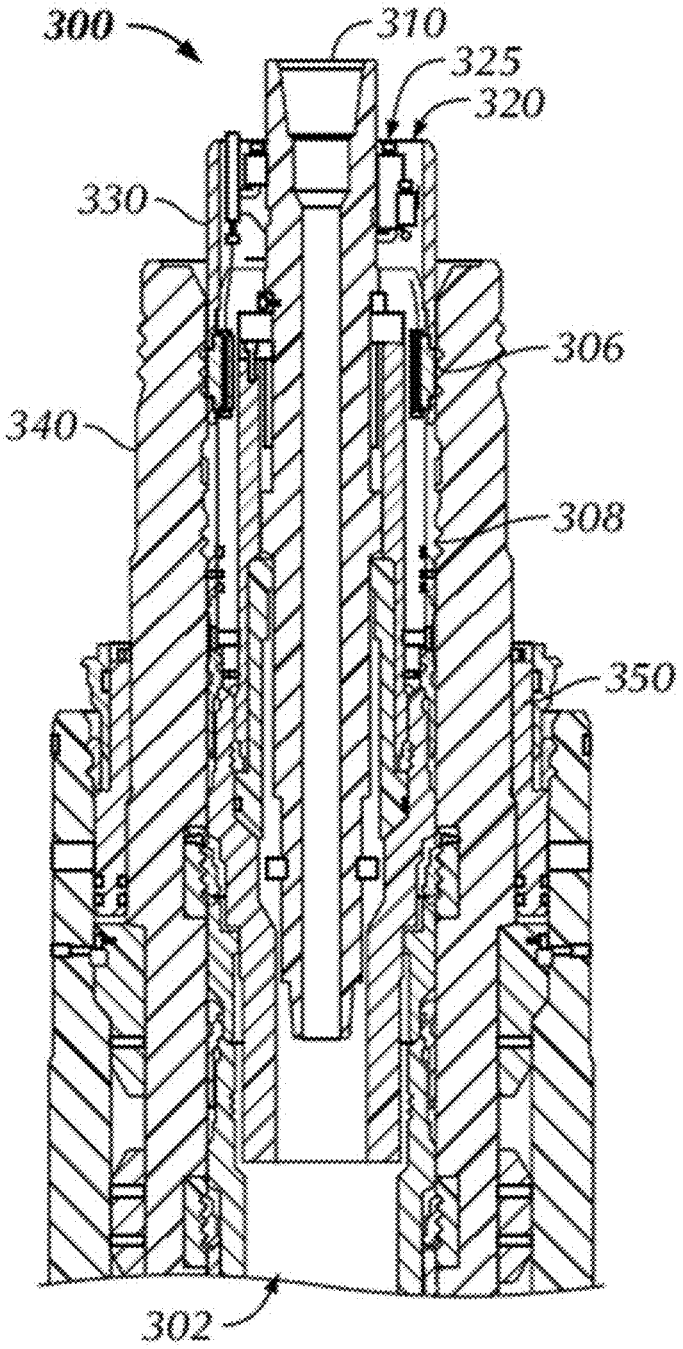
FIG. 13A shows a cross sectional view of a lead impression system according to embodiments of the present disclosure at a first downhole location along the downhole component.
Figure 13B:
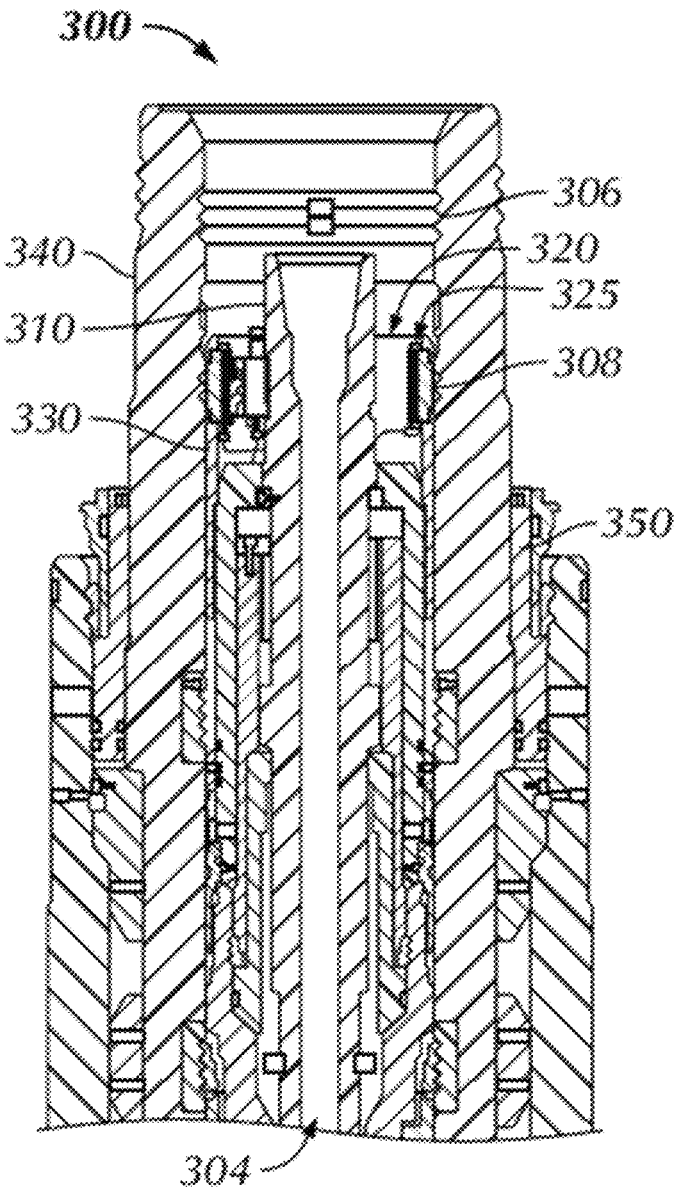
FIG. 13B shows a cross sectional view of a lead impression system according to embodiments of the present disclosure at a second downhole location along the downhole component.

For example, referring now to FIGS. 13A and 13B, cross sectional views of a lead impression system 300 in a first downhole location 302 and in a second downhole location 304 (axially lower than the first downhole location 302) is shown. The lead impression system 300 includes a downhole tool 310, an actuatable assembly 320 disposed around the downhole tool 310, and an outer sleeve 330 attached around the actuatable assembly 320 and downhole tool 310. At the downhole locations, a first surface feature 306 and a second surface feature 308 are located at different axial positions. In the embodiment shown, the first and second surface features 306, 308 are formed along a casing hanger 340. However, other downhole components, such as casings, tubulars, etc. may have impressions taken according to embodiments of the present disclosure. The two surface features 306, 308 are different so that once they are imprinted on the lead pad, they can be easily distinguished from one another. Thus, taking a lead impression along at least two different axial positions may help with locating the lead impression system 300 with respect to its axial position along where on the host casing the downhole tool landed.

Obtaining lead impressions according to the present disclosure may begin with assembling the actuatable assembly 320 to the outer sleeve 330 and positioning the actuatable assembly 320 and outer sleeve 330 radially around the downhole tool 310, wherein the actuatable assembly 320 may be directly mounted to the outer sleeve 330 through one of many mounting mechanisms such as socket head screws. The lead impression system 300 may then be sent downhole where a casing hanger 340 lands on a hanging area. An annulus seal assembly 350 setting or testing may be performed around the hanging area to isolate a pressure of the production line from the annulus. The annulus seal assembly 350 may be set or tested with an increase in an external pressure above the downhole tool 310, which can be manipulated by an operator.

As the external pressure above the downhole tool 310 increases, a piston within the actuatable assembly 320 may displace hydraulic fluid across a check valve an into a fluid communication system, as discussed above with respect to FIGS. 9-12. This results in an increase in the internal pressure of the actuatable assembly 320, and equalization of the external pressure, the internal pressure of the actuatable assembly 320, and the pressure of the accumulator.

After the annulus seal assembly 350 is set or tested, the pressure above the downhole tool 310 is bled down, which creates a pressure differential across the lead impression module 325 and the pressure relief device within the actuatable assembly 320. At least one lead pad begins to expand as the force exerted by the internal pressure of the actuatable assembly exceeds the impeding forces from the springs and the seal friction holding the lead pad in the retracted position. The lead pad may then expand and come in contact with an interior surface of the hanging area of the casing hanger 340, where the lead pad obtains a lead impression of the surface features 306, 308 of the hanging area in order to indicate a current axial position of the casing hanger 340.

When the pressure in the actuatable assembly 320 decreases, the force exerted by the internal pressure in the actuatable assembly 320 on the lead pad decreases, thereby allowing the springs to retract the lead pad. Ultimately the pressure in the actuatable assembly 320 and the external pressure are equalized and the lead pad is fully retracted. When the lead pad is in retracted position, the lead impression system 300 may be pulled back up to the surface to analyze the lead impression taken.

The axial position can be determined by analyzing the surface features 306, 308 of the hanging area that are different with the axial position. In other words, the downhole location of the downhole tool 310 may be known when an operator sends the downhole tool 310 (and attached actuatable assembly 320) downhole. Thus, the downhole location of the impression taken may also be known. From the known location of the impression, the location of any surface features impressed may be determined.

The example shown in FIGS. 13A and 13B show lead impressions taken during an operation of setting an annulus seal assembly. However, lead impressions may be taken during other downhole operations known to those skilled in the art, or may be taken without conducting a concurrent downhole operation.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed is:

1. A lead impression system, comprising:
- a downhole tool;
- an outer sleeve assembled radially around the downhole tool, comprising:
  - a wall; and
  - at least one window formed through the wall; and
- a lead impression assembly assembled radially between the downhole tool and the outer sleeve, comprising:
  - at least one accumulator;
  - a pressure relief device;
  - at least one piston comprising a piston head disposed within a bore of a piston chamber, wherein a first side of the piston head is in fluid communication with a port to the at least one accumulator;
  - at least one lead impression module comprising:
    - a lead pad aligned with the at least one window in the outer sleeve;
    - a piston module; and
    - springs configured to apply a pressure from the piston module to the lead pad and from the lead pad to the piston module; and
  - a plurality of conduits and valves in fluid communication between the at least one accumulator, the pressure relief device, the at least one piston, and the at least one lead impression module.

2. The system according to claim 1, wherein the downhole tool is a single trip completion or drilling tool.

3. The system according to claim 1, wherein the lead impression assembly comprises multiple lead impression modules positioned at different axial positions along the downhole tool.

4. The system according to claim 1, wherein the lead impression assembly comprises multiple lead impression modules positioned axi-symmetrically around the downhole tool.

5. The system according to claim 1, wherein the downhole tool comprises a mounting interface, wherein the outer sleeve is assembled onto the mounting interface of the downhole tool.

6. A lead impression assembly, comprising:
- at least one accumulator charged to a pre-set pressure;
- a pressure relief device;
- at least one piston comprising a piston head disposed within a bore of a piston chamber, wherein one side of the piston head is in a fluid communication with a port to the at least one accumulator and the other side in fluid communication with an environment surrounding the lead impression assembly;
- at least one lead impression module comprising:
  - a lead pad;
  - a piston module; and
  - springs configured to apply a pressure from the piston module to the lead pad and from the lead pad to the piston module; and
- a plurality of conduits and valves in fluid communication between the at least one accumulator, the pressure relief device, the at least one piston, and the at least one lead impression module.

7. The assembly according to claim 6, comprising two pairs of the lead impression modules, wherein the two pairs are connected to the assembly via a three-way valve.

8. The assembly according to claim 6, wherein the lead impression assembly comprises multiple lead impression modules positioned at different axial positions.

9. The assembly according to claim 6, wherein the lead impression assembly comprises multiple lead impression modules positioned axi-symmetrically around the downhole tool.

10. The assembly according to claim 6, wherein the plurality of conduits and valves comprises at least one check valve positioned along at least one of the plurality of conduits that extends between the at least one accumulator and the at least one piston.

11. The assembly according to claim 10, wherein the check valve allows fluid flow in a flow direction from the at least one piston to the at least one accumulator.

* * * * *